US006068173A

United States Patent [19]

Sueda

[11] Patent Number: 6,068,173

[45] Date of Patent: May 30, 2000

[54] SIMPLE TYPE POWER STAPLER

[75] Inventor: Norio Sueda, Nagoya, Japan

[73] Assignee: Aska Corporation Ltd., Nagoya, Japan

[21] Appl. No.: 09/387,799

[22] Filed: Sep. 1, 1999

[30] Foreign Application Priority Data

May 13, 1999 [JP] Japan ..... 11-132816

[51] Int. Cl.[7] ..... B27F 7/36

[52] U.S. Cl. ..... 227/7; 227/131

[58] Field of Search ..... 227/7, 131, 2, 227/6

[56] References Cited

U.S. PATENT DOCUMENTS

| | | | |
|---|---|---|---|
| 5,007,572 | 4/1991 | Chung-Cheng | 227/131 |
| 5,012,967 | 5/1991 | Johansson | 227/7 |
| 5,195,671 | 3/1993 | Shimomura et al. | 227/7 |
| 5,222,645 | 6/1993 | Sueda . | |
| 5,427,296 | 6/1995 | Chen | 227/7 |
| 5,657,918 | 8/1997 | Shimomura et al. | 227/131 |
| 5,671,879 | 9/1997 | Lin | 227/131 |

FOREIGN PATENT DOCUMENTS

| | | |
|---|---|---|
| 4-217471 | 8/1992 | Japan . |
| 6-39742 | 2/1994 | Japan . |
| 6-39743 | 2/1994 | Japan . |

*Primary Examiner*—Scott A. Smith

*Attorney, Agent, or Firm*—Oblon, Spivak, McClelland, Maier & Neustadt, P.C.

[57] ABSTRACT

A simple type power stapler has a main body 1, a punching arm 2, a housing frame 3, a hanging means 8 having a hook member 81 engaging with an upper portion of the punching arm 2 and a support portion 80 for supporting a lower portion of the housing frame 3, and a pushing member movable vertically by a motor 5 wherein a pair of support frames 22 are provided above the punching arm so as to accommodate the vertically movable pushing member; the punching arm 2 and the housing frame 3 descend by their own weight to lower their front end side F so that a lower surface 32 of the front end of the housing frame 3 pushes an upper surface of an object to be stapled W when the pushing member is moved downward; and the distance between the hook portions 81 and the support portion 80 of the hanging means 8 is determined to have a dimension which allows the downward movement of the front end side F of the punching arm 2 caused by the movement of the pushing member to its lowest position whereby staple pins P are punched out through the punching outlet 30 by means of the staple pin punching plate 20.

3 Claims, 21 Drawing Sheets

SIMPLE TYPE POWER STAPLER

BACKGROUND OF THE INVENTION

1. Field of the Invention

The present invention relates to a simple type power stapler which can move vertically a front end of a housing frame for staple pins as a main component of the stapler without any trouble in a stapling operation. In particular, it relates to a simple type power stapler capable of stapling suitably staple pins to an object to be stapled with flexibility with a change of the thickness of the object to be stapled.

2. Discussion of Background

There are the following prior art documents relating to simple type power staplers which have been invented by the inventor of this application:

(1) JP-A-4-217471, (2) JP-A-6-39742, (3) JP-A-6-39743 and (4) U.S. Pat. No. 5,222,645.

These conventional power staplers are, as shown in FIGS. 28 and 29, of a type that a housing frame 100 is fixed to the main body. Namely, a distance x between a lower surface of a front end portion 100*a* of the housing frame 100 (i.e., an edge where a staple pin punching outlet 100*b* is formed) and a base portion 110 is fixed. In these staplers, the thickness of an object to be stapled W such as a plurality of documents or sheets (hereinbelow, referred to simply as documents) stapled by these staplers was limited to such distance x. In case that documents W having a much more volume are to be stapled without changing the basic structure of these conventional power staplers, it is necessary to further raise the front end portion 100*a* of the housing frame 100 fixed to the main body so as to increase the distance x between the front end portion 100*a* and the base portion 110. In an attempt to simply widen the distance between the housing frame 100 fixed to the main body and the base portion 110, the following disadvantage occurs when the volume (the thickness) of the documents W is small. Namely, the pin legs Pa of staple pins P can not be guided by inner walls 100*c* of the housing frame 100 even by lowering a staple pin punching plate 120*a* due to a descending movement of a punching arm 120, whereby the staple pins P can not appropriately be stapled into the documents W.

On the other hand, in a manually operable stapler generally used as shown in FIG. 30, in which a housing frame 100 is pivotally attached to the main body and a spring for lifting the housing frame is provided between a base portion 110 and the housing frame 100, a relatively large distance can be maintained between a front end portion 100*a* of the housing frame 100 and the base portion 110, and the housing frame 100 can also be lowered at the time of lowering a punching arm 120 so that staple pins P can properly be stapled by guiding the pin legs Pa of the staple pins P by inner walls 100*c* of the housing frame 100 even when the thickness of documents W is relatively small.

However, in a simple type power stapler provided with such frame lifting spring between the housing frame 100 and the base portion 110, power for driving the punching arm 120 is generally obtainable from a battery received inside the stapler, but without relying on power from an outer power source. As a result, power against the spring action of the spring is relatively large, and a service life of the battery is relatively short.

SUMMARY OF THE INVENTION

It is an object of the present invention to provide a simple type power stapler which can move downward a punching arm and a housing frame for staple pins as major components of the stapler by using an electrical driving source while with a minimum necessary power at the time of stapling operations of staple pins to an object to be stapled, and which is flexible in stapling operations with a change of the thickness of the object to be stapled.

Further, it is an object of the present invention to provide a power stapler which reduces the number of elements constituting the housing frame without reducing function as the stapler; reduces the dimension in a vertical direction of the housing frame, and is easy in assembling while providing a compact structure.

Further, it is an object of the present invention to provide a power stapler which can change within a certain range the position of stapling the staple pins to the object to be stapled without reducing function as the power stapler.

In accordance with an aspect of the present invention, there is provided a simple type power stapler which comprises a main body having a base portion; a punching arm having a rear end portion which is pivotally connected to the main body and a front end portion provided with a staple pin punching plate; a housing frame for staple pins which has a rear end portion pivotally connected to the main body and a front end portion provided with a staple pin punching outlet, and a hanging means for hanging the housing frame to the punching arm, which is provided with a hook member engaging with an upper portion of the punching arm and a support member for supporting a lower portion of the housing frame, wherein the main body includes a pushing member which is vertically movable by driving a motor; a supporting frame for accommodating the pushing member so as to be movable in a vertical direction is provided in an upper portion of the punching arm; a space for an object to be stapled is formed between the front end portion of the housing frame and the base portion in a state that the punching arm and the housing frame are hanged by the pushing member, when it is at an upper position, in association with the supporting frame; the punching arm and the housing frame are so adapted to descend by their own weight when the pushing member is moved downward by the driving force of the motor whereby a lower surface of the front end portion of the housing frame comes to contact with an upper surface of the object to be stapled, and the distance between the hook member and the support member of the hanging means is determined to have a dimension which allows the downward movement of the front end portion of the punching arm caused by the movement of the pushing member to its lowest position whereby staple pins in the housing frame are punched out by the staple pin punching plate through the punching outlet.

In the structure described above, the punching arm and the housing frame can be moved downward by their own weight when the pushing member is moved downward wherein power from the motor to move the pushing member can be reduced to a minimum necessary extent. Further, staple pins can be punched out with the staple pin punching plate in a state that the lower surface of the front end portion of the housing frame is in contact with an upper face of the object to be stapled, whereby stapling operations can be done to an object having a smaller thickness.

Further, according to a second aspect of the present invention, there is provided the simple type power stapler according to the first aspect wherein the housing frame comprises a frame main body provided with a staple pin receiving portion at its upper side and a frame cover having an opened bottom, which covers an upper surface of the frame main body, wherein a pair of side walls formed in a longitudinal direction of the frame cover and a pair of side walls formed in a longitudinal direction of the frame main body are assembled with a pair of assembling members comprising elongated grooves and elongated projections, which are mutually fitted, so that the frame main body is drawn from a front end side of the housing frame out of the frame cover so as to be ready for setting staple pins.

The housing frame in a conventional stapler has a three-element structure which comprises a frame main body adapted to receive staple pins from an upper side, a frame casing having an opened upper face which supports the frame main body from its lower side and a frame cover for preventing the staple pins from coming off from an upper side of the frame main body. In such conventional stapler, if the frame casing can be omitted from the housing frame without reducing function as the stapler, the dimension in the vertical direction of the housing frame can be reduced, or the thickness of a lower portion of the frame casing can be reduced. Further, the number of constituent elements can be reduced.

According to the second aspect of the present invention, the housing frame has a two-component structure comprising the frame main body and the frame cover wherein the dimension in the vertical direction of the housing frame itself can be reduced. Further, the housing frame can be drawn from the frame cover so that staple pins can be inserted in the housing frame without trouble.

According to a third aspect of the present invention, there is provided the power stapler according to the first aspect wherein a movable member on which a switch is mounted is provided so as to be movable from a front side of the housing frame toward a rear side thereof, said switch is adapted to close a circuit for the motor when the switch comes to contact with an end of the object to be stapled which is inserted between the base portion and the front end portion of the housing frame.

In the before-mentioned conventional power stapler, the distance between a switch, which closes a control circuit for the motor for driving the punching arm downward when the object to be stapled is inserted, and the staple pin punching outlet formed in the housing frame could not be changed. Accordingly, the distance between an end of the object and the position where staple pins are stapled could not be changed.

According to the third aspect of the present invention, the movable member can be moved to a desired position within a certain range. Accordingly, the distance between the switch and the staple pin punching outlet of the housing frame can be changed with a result of changing the position of stapling stapling pins to the object.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following, a preferred embodiment of the simple type power stapler according to the present invention will be described with reference to the drawings.

Figure 1:
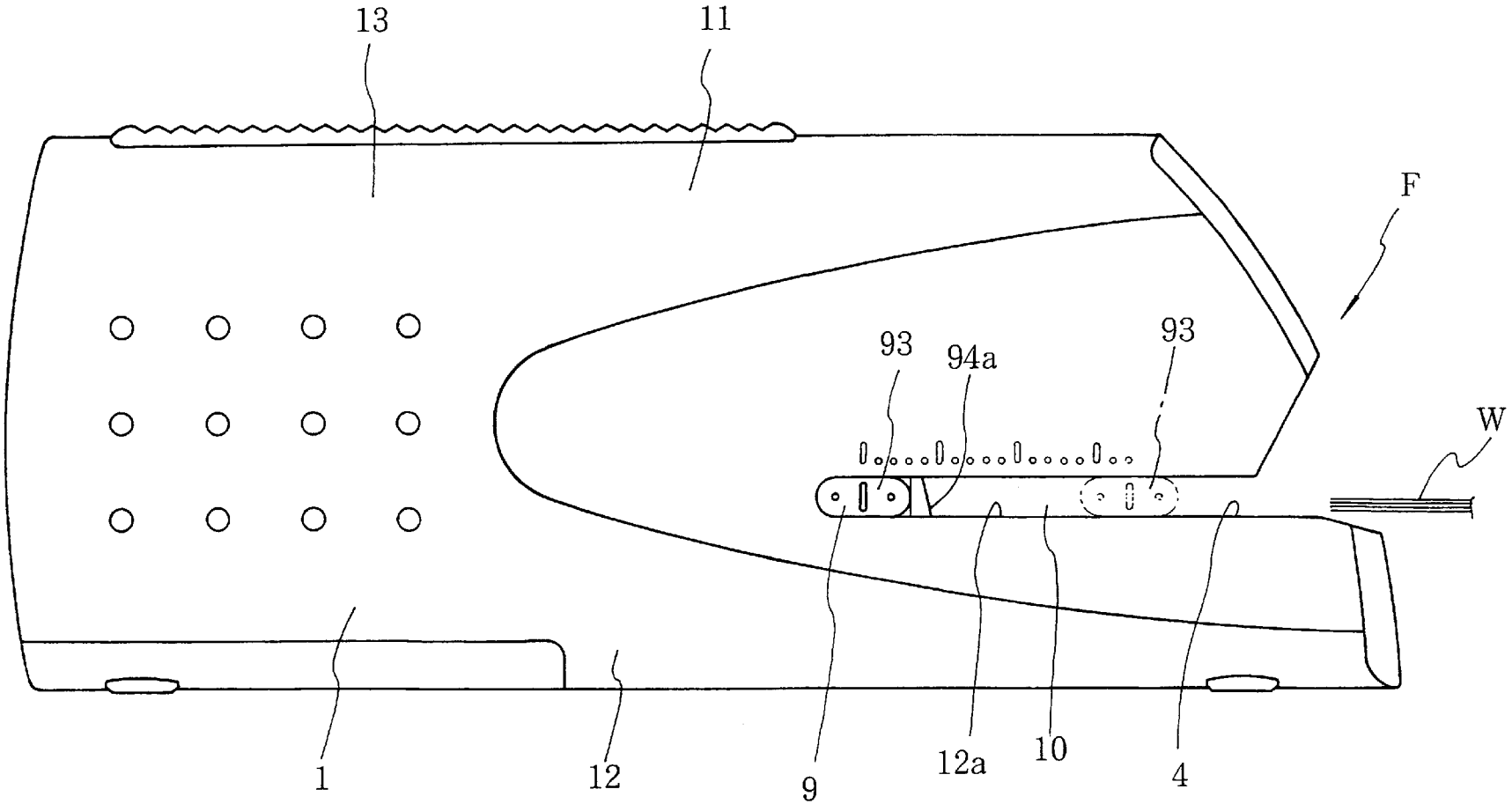
FIG. 1 is a front view of an embodiment of the power stapler of the present invention.
Figure 2:
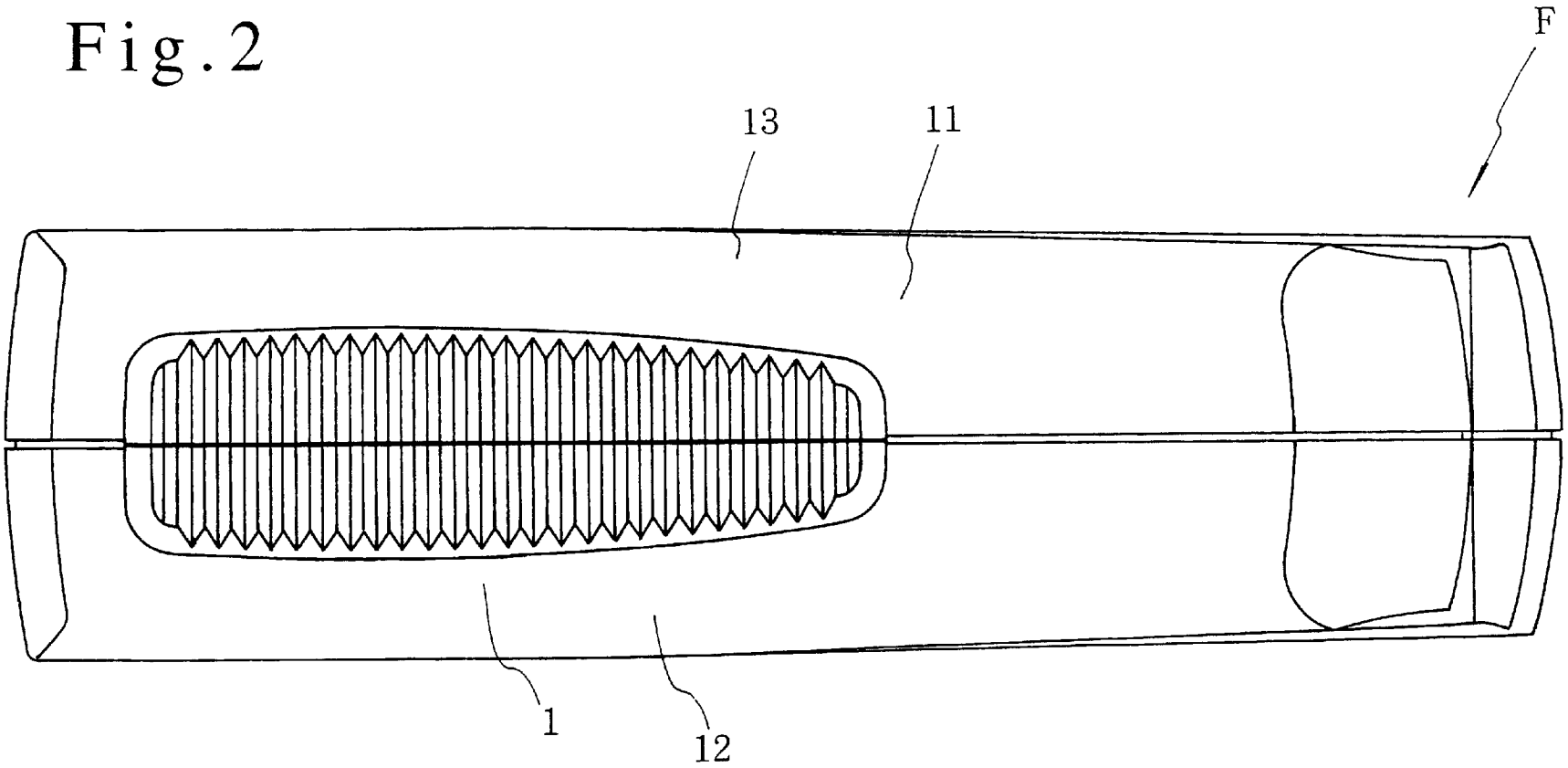
FIG. 2 is a plain view of the power stapler.
Figure 3:
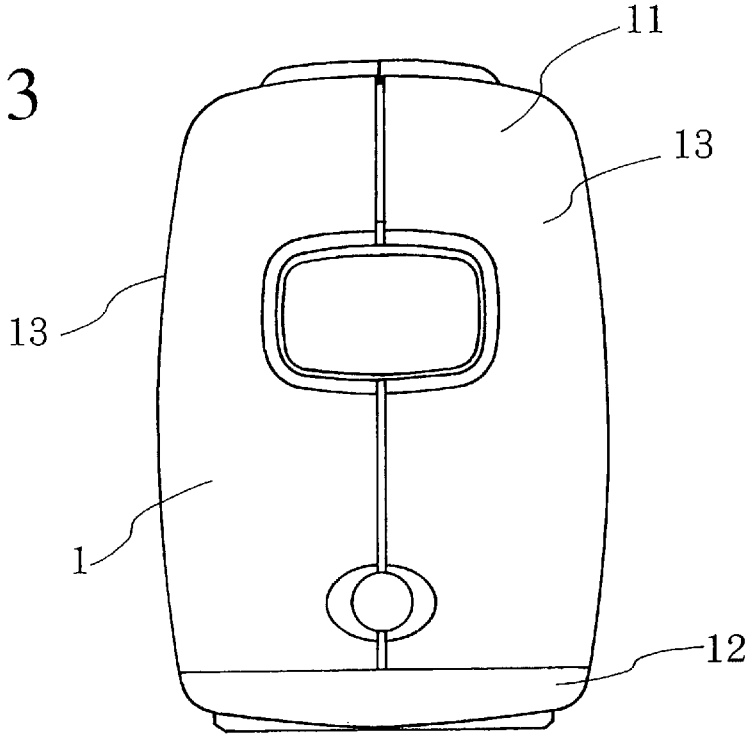
FIG. 3 is a side view of the power stapler shown in FIG. 1 which is viewed from a side direction.
Figure 4:
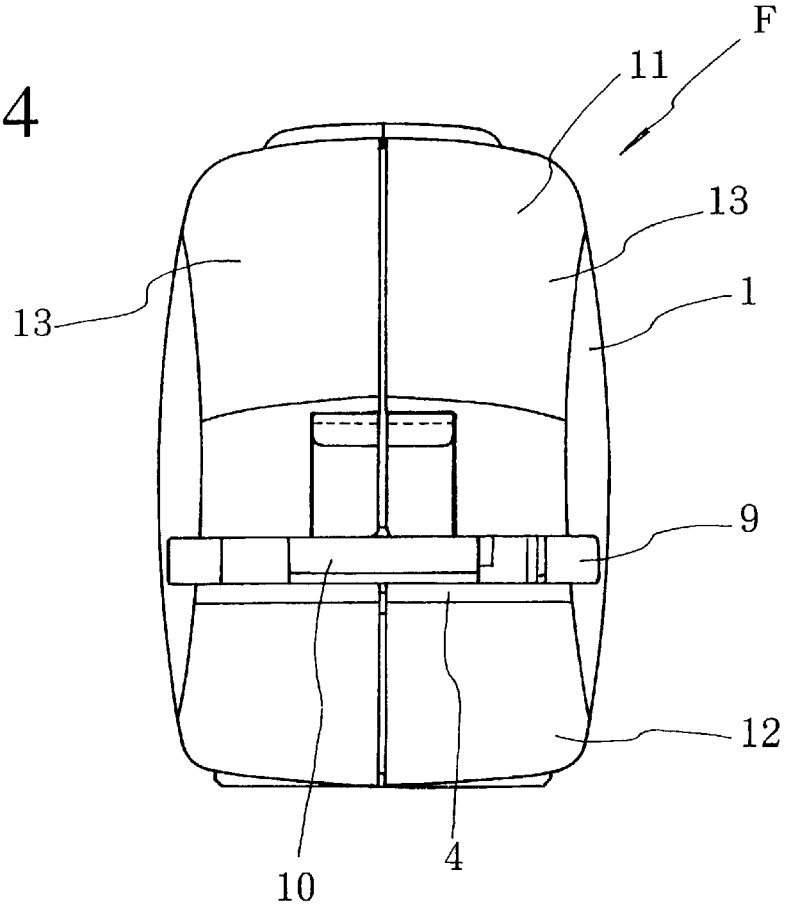
FIG. 4 is a side view of the power stapler viewed from the opposite direction from that in FIG. 3.

FIGS. 1 through 4 show outer appearances of an embodiment of the power stapler wherein FIG. 1 is a front view; FIG. 2 is an upper plain view; FIG. 3 is a side view viewed from a left side in FIG. 1, and FIG. 4 is a side view from a right side in FIG. 1.

Figure 5:
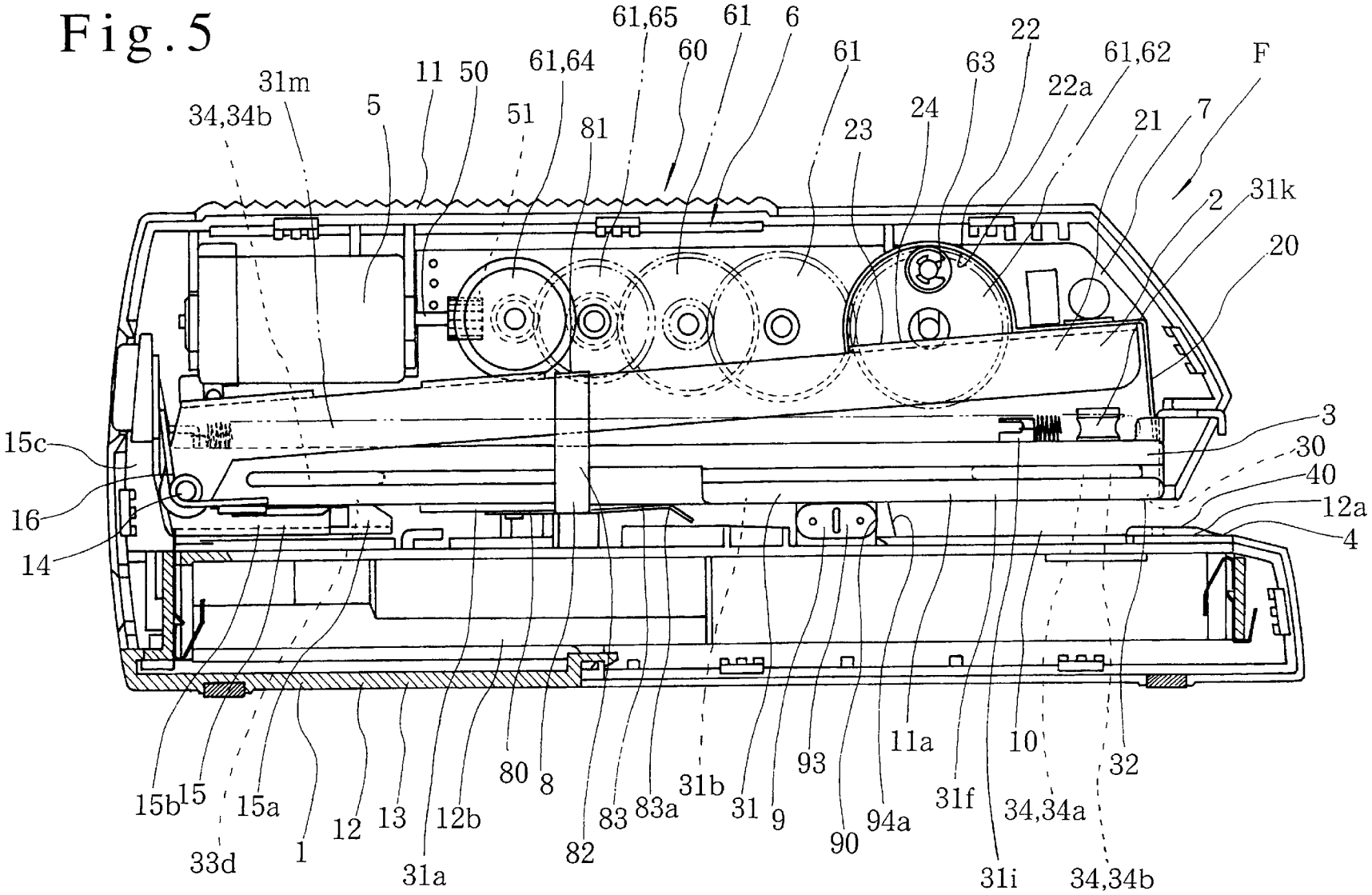
FIG. 5 is a front view showing constituent elements of the power stapler of the present invention.
Figure 6:
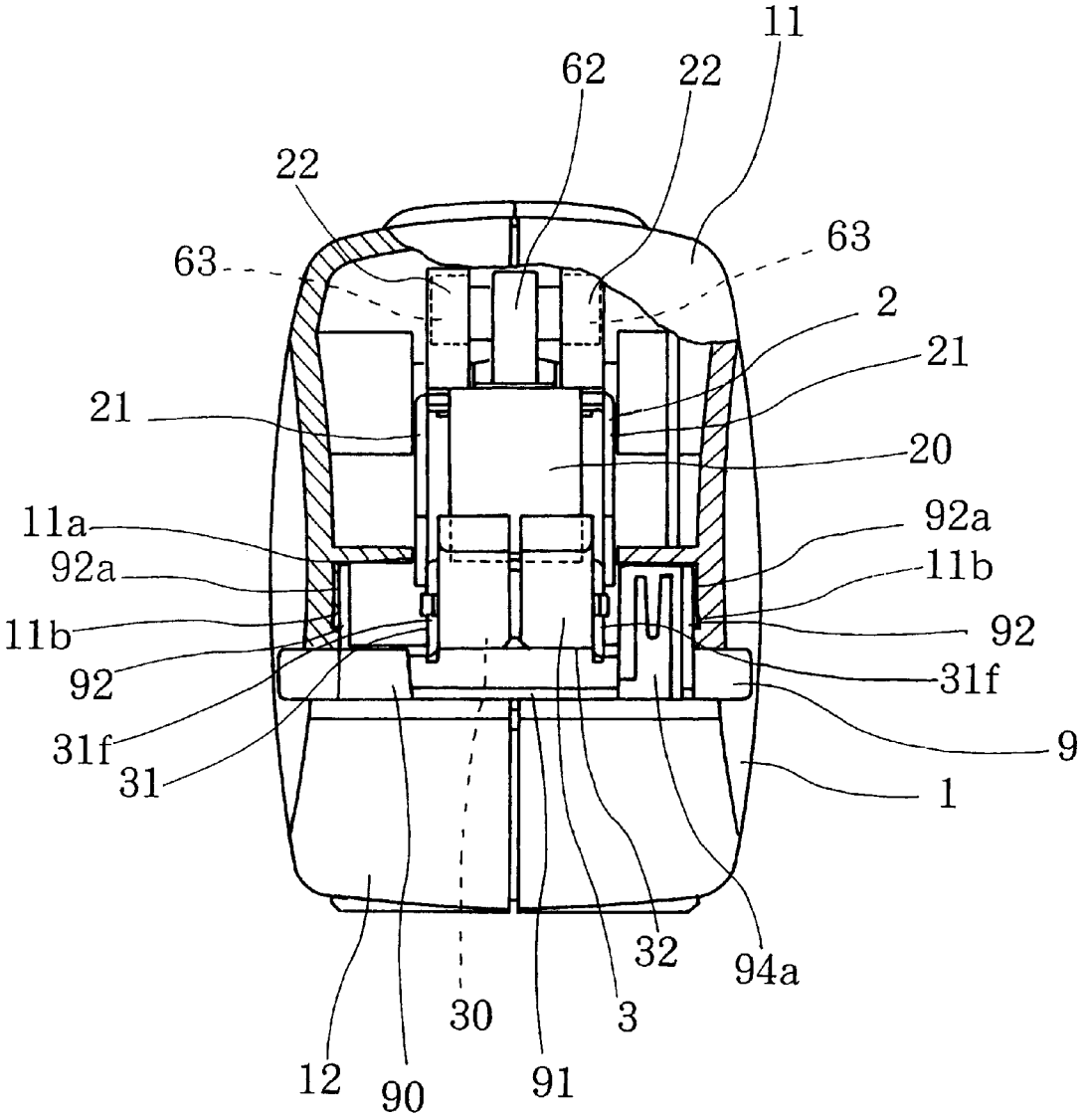
FIG. 6 is a side view partly broken to show the constituent elements of the power stapler.
Figure 7:
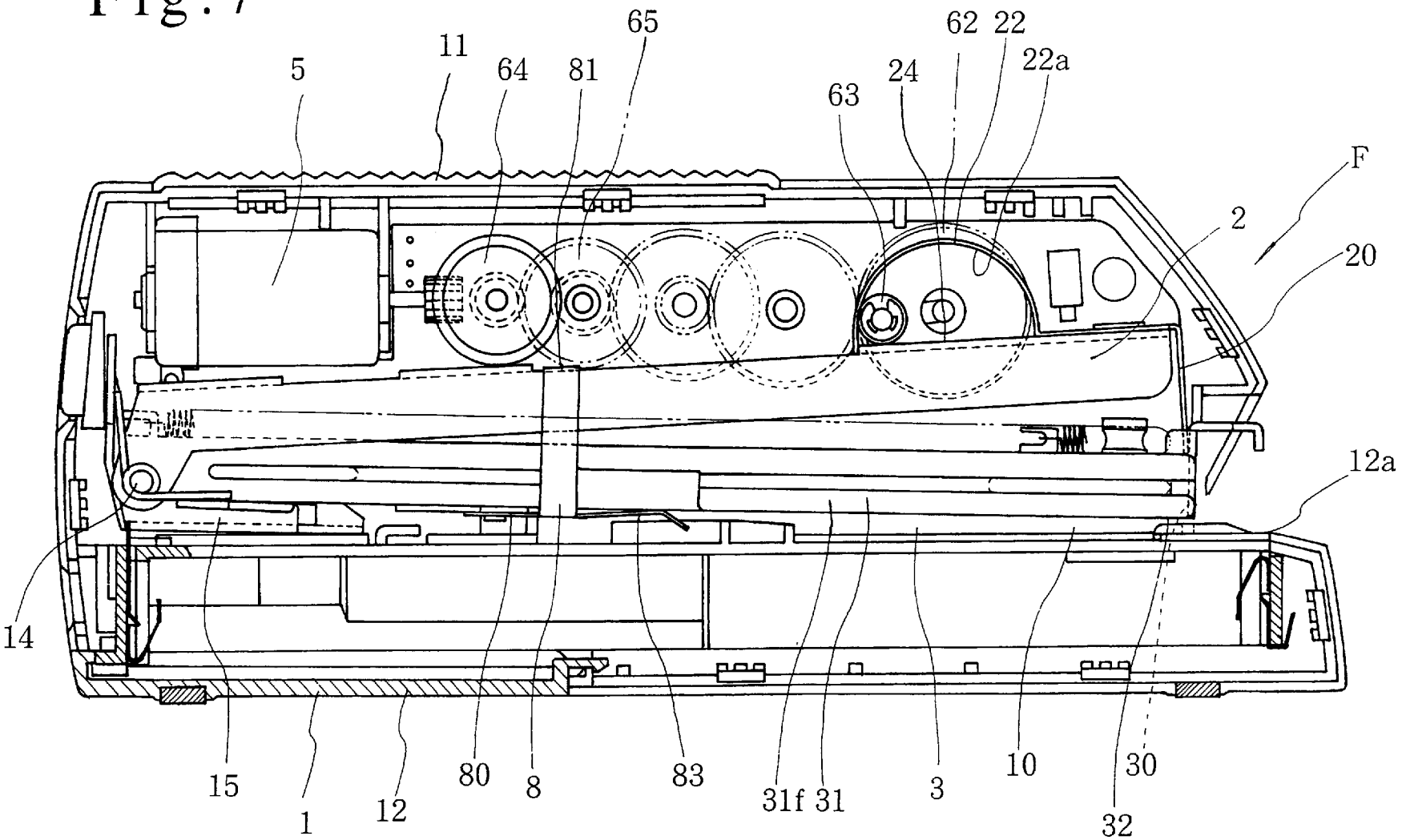
FIGS. 7 and 8 are front views showing the constituent elements in different stages of operation with respect to the stage shown in FIG. 5.
Figure 8:
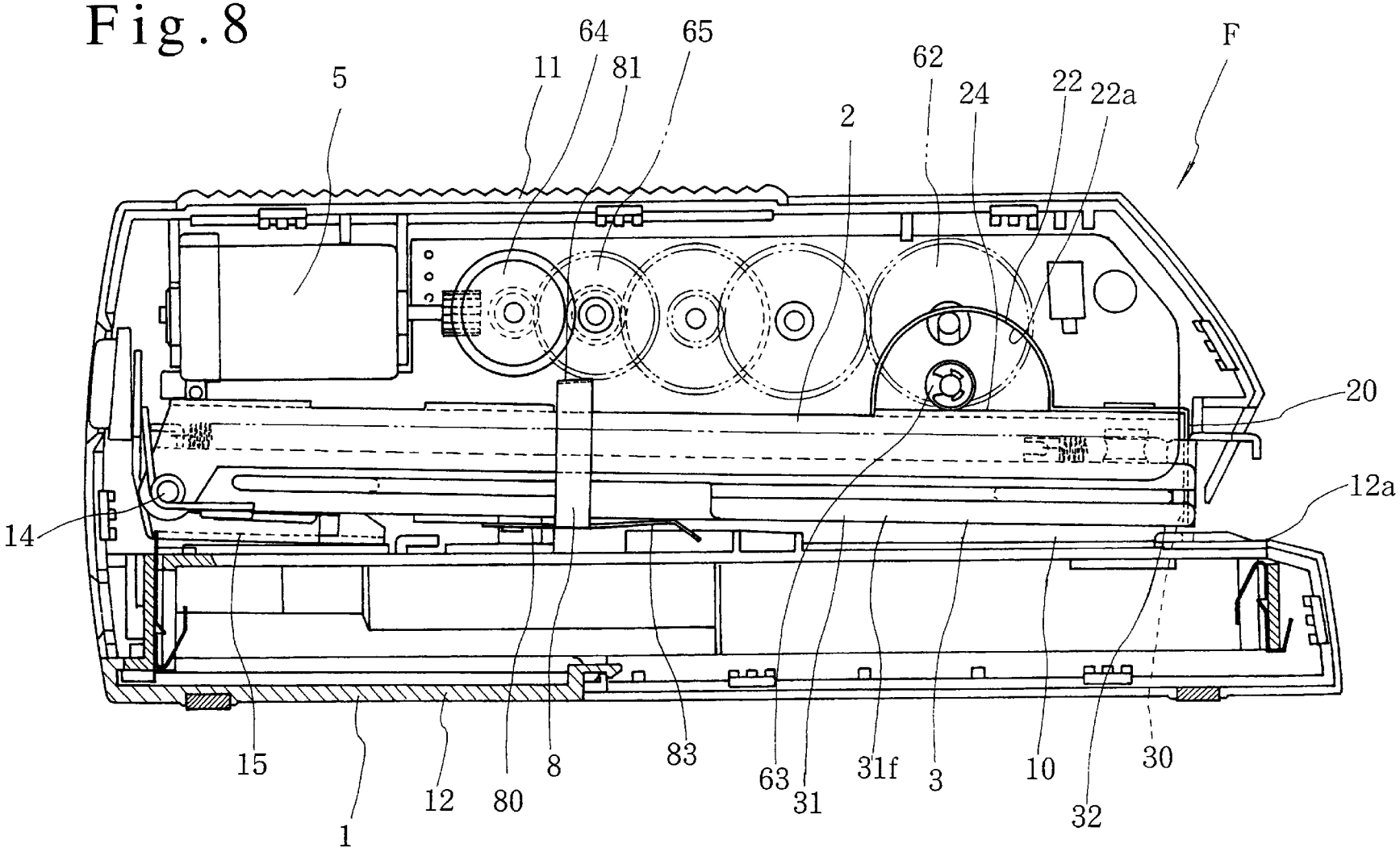
Figure 9:
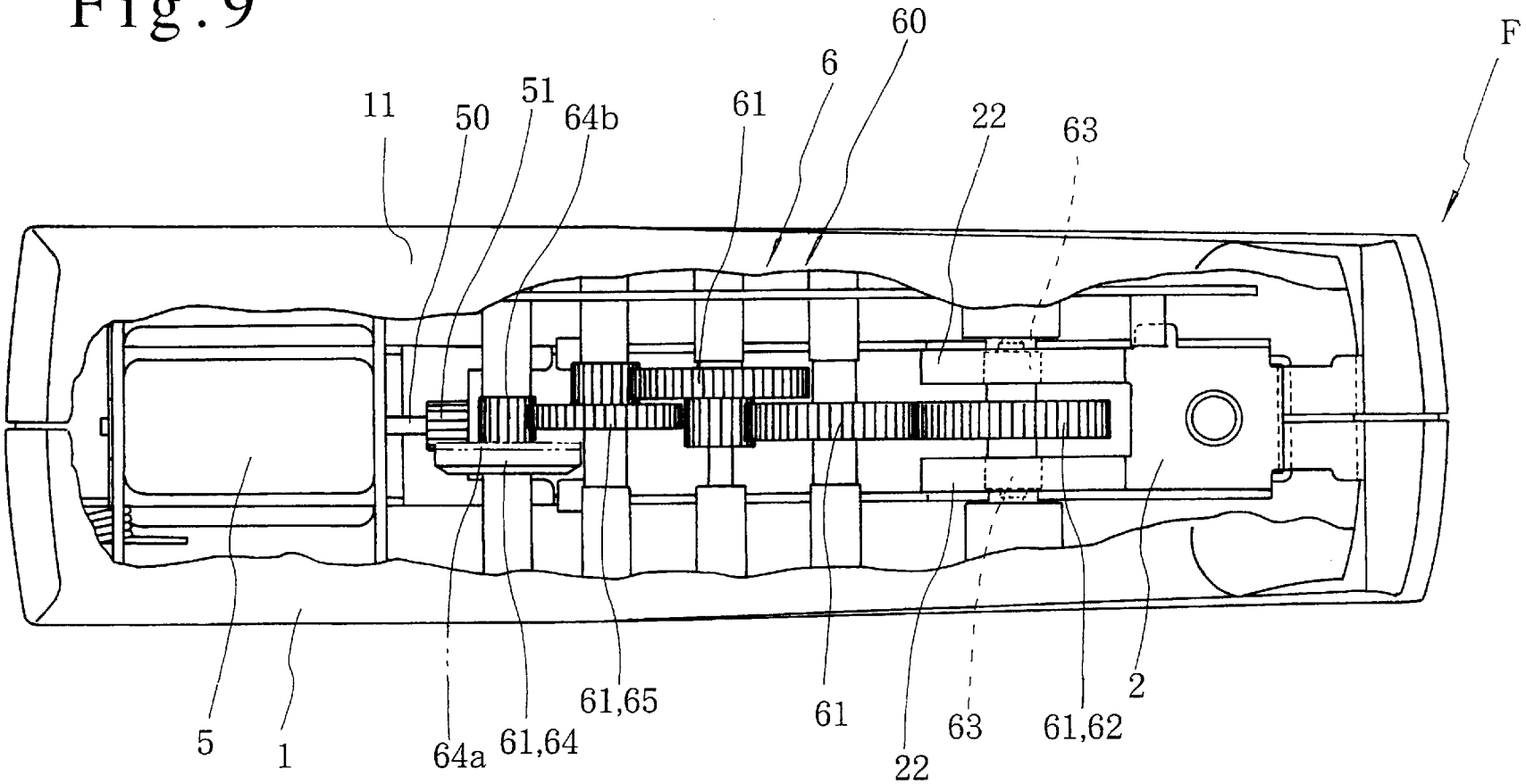
FIG. 9 is a plain view partly broken to show the constituent elements of the power stapler.

FIGS. 5, 7 and 8 show in particular constituent elements of the power stapler by removing one of casing halves 13 as parts of the power stapler wherein FIG. 5 shows a set-up state (which will be described hereinafter); FIG. 8 shows a final stage of stapling operations, and FIG. 7 shows an intermediate stage of stapling operations. A one-cycle operation is performed in the order of stages of FIG. 5, FIG. 7, FIG. 8 and FIG. 5 (in FIGS. 7 and 8, a movable member 9 is omitted). FIG. 6 is a side view observed from the direction of a front end side F of the power stapler shown in FIG. 1 wherein the front end side F is removed to show constituent elements accommodated in the power stapler. FIG. 9 shows the constituent elements of the power stapler from an upper part thereof by removing a part of an upper housing 11 of the power stapler.

Figure 10:
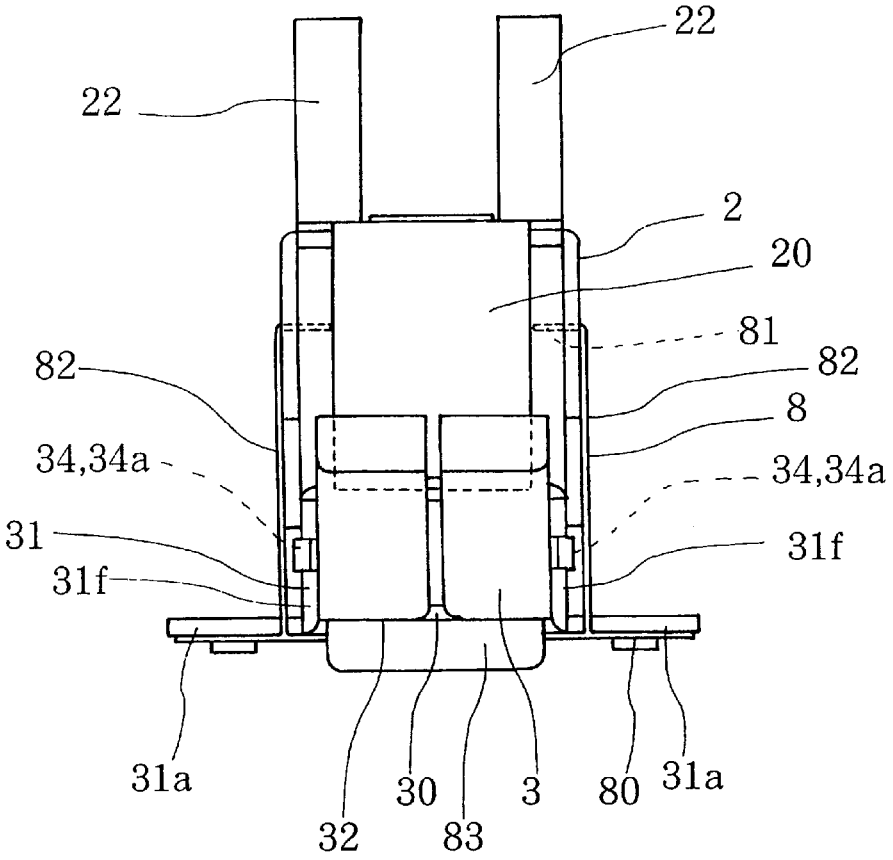
FIG. 10 is a diagram showing a punching arm 2 and a housing frame 3 viewed from a front end side F.
Figure 11:
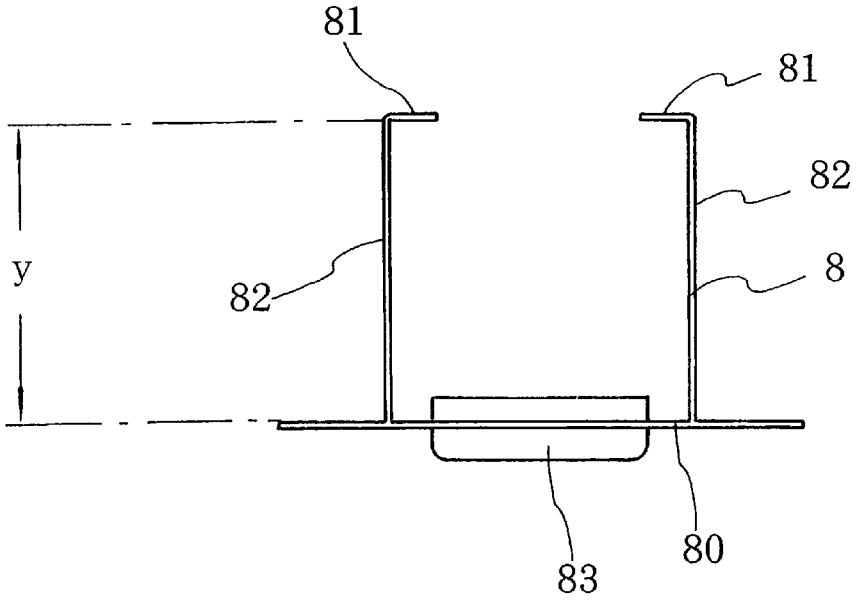
FIG. 11 is a front view of a hanging means 8.
Figure 12:
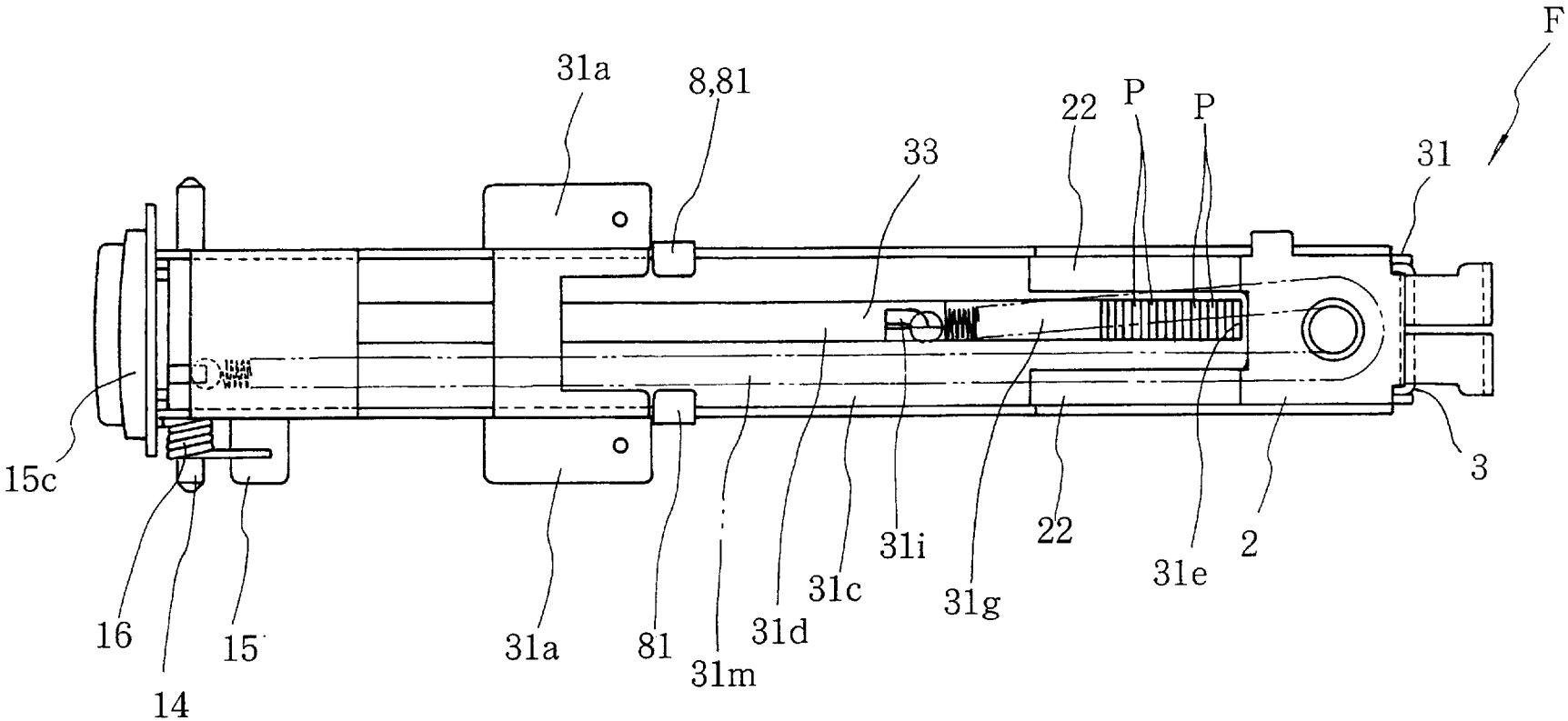
FIG. 12 is a plain view of a frame cover 31 and a frame main body 33 which is in entirely housed in the frame cover 31.
Figure 13:
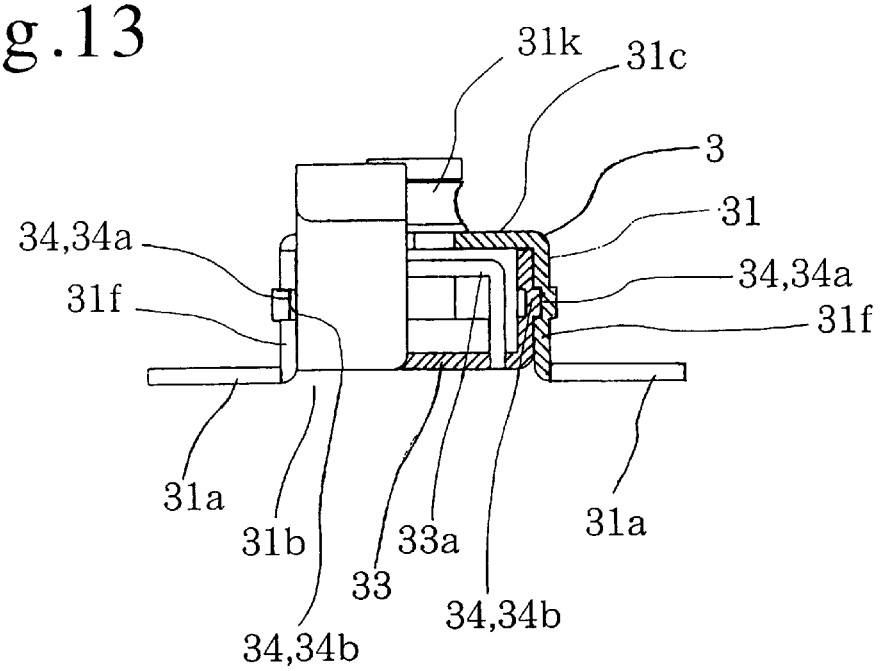
FIG. 13 is a front view partly broken showing a state that the frame main body 33 is assembled to the frame cover 31.

FIG. 10 shows a punching arm 2 and a housing frame 3 observed from the front end side F. FIG. 11 shows a hanging means 8 observed from the opposite side of the front end side, which supports in a hanging state the housing frame 3 to the punching arm 2. FIG. 12 shows the punching arm 2 and the housing frame 3 observed from an upper portion thereof wherein a frame main body 33 is in an entirely accommodated position in a frame cover 31. FIG. 13 is a front view, a right half thereof being cross-sectioned, for understanding a state of the frame main body 33 received and assembled in the frame cover 31.

Figure 14:
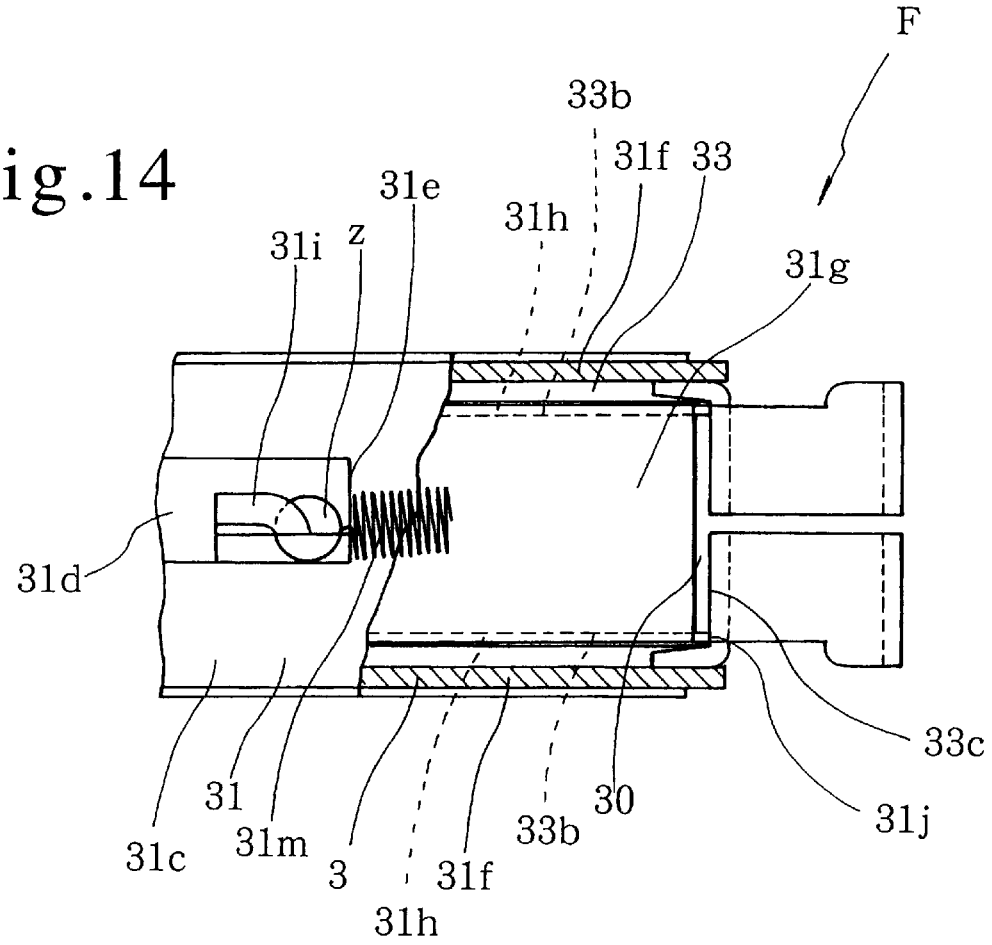
FIG. 14 is an enlarged plain view partly broken of a part of the front end side F of the frame cover 31.
Figure 15:
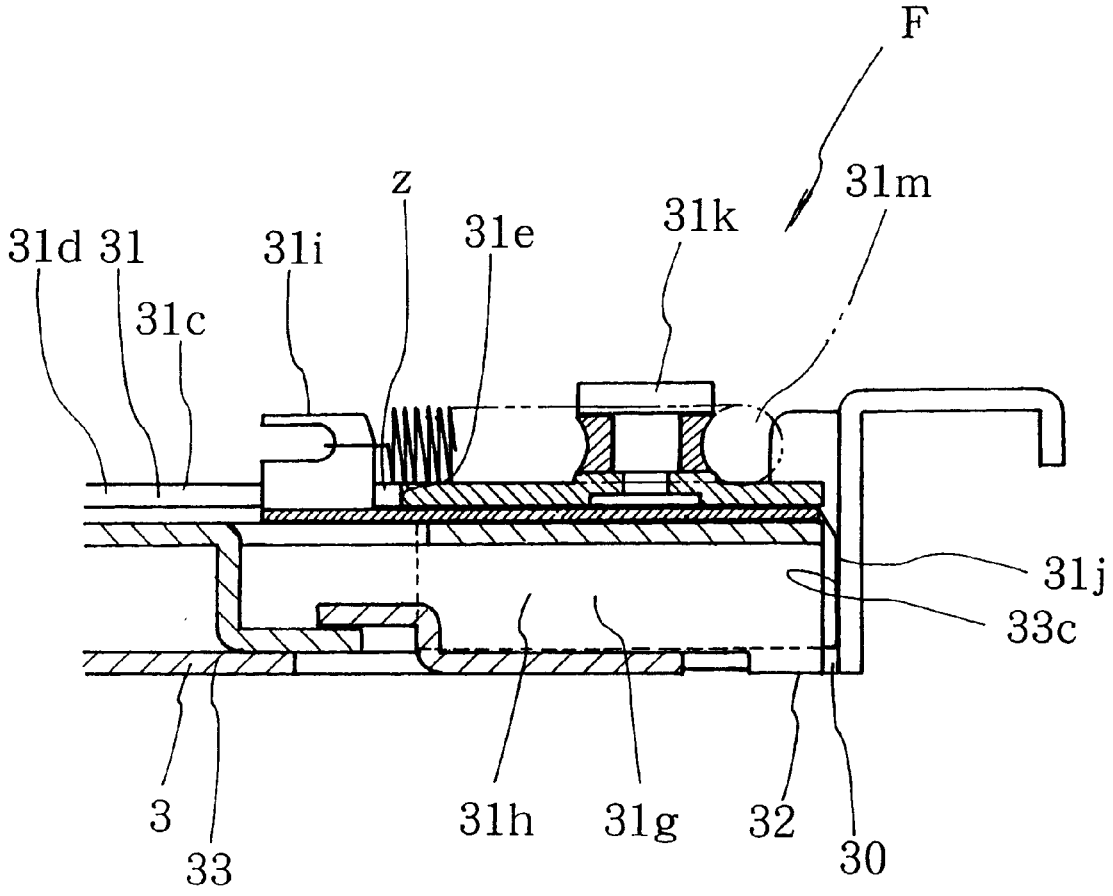
FIG. 15 is a front view partly broken showing a part the front end side F of the frame main body 33 and the frame cover 31.
Figure 16:
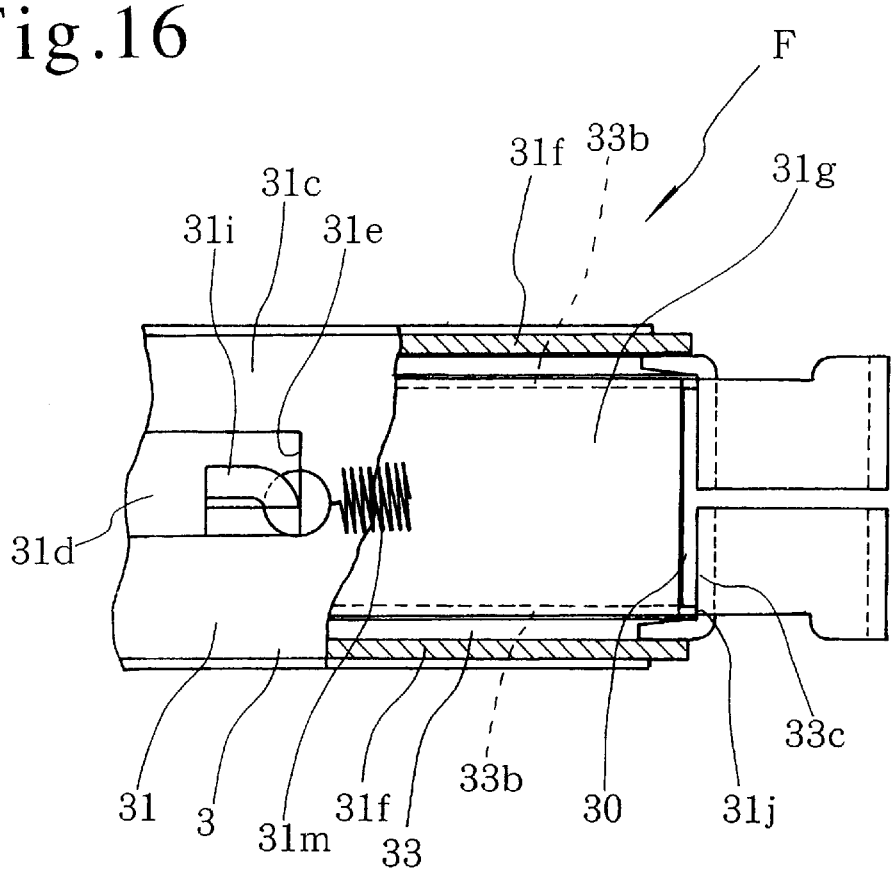
FIG. 16 is a plain view partly broken showing a part of the front end side F of the frame cover 31.
Figure 17:
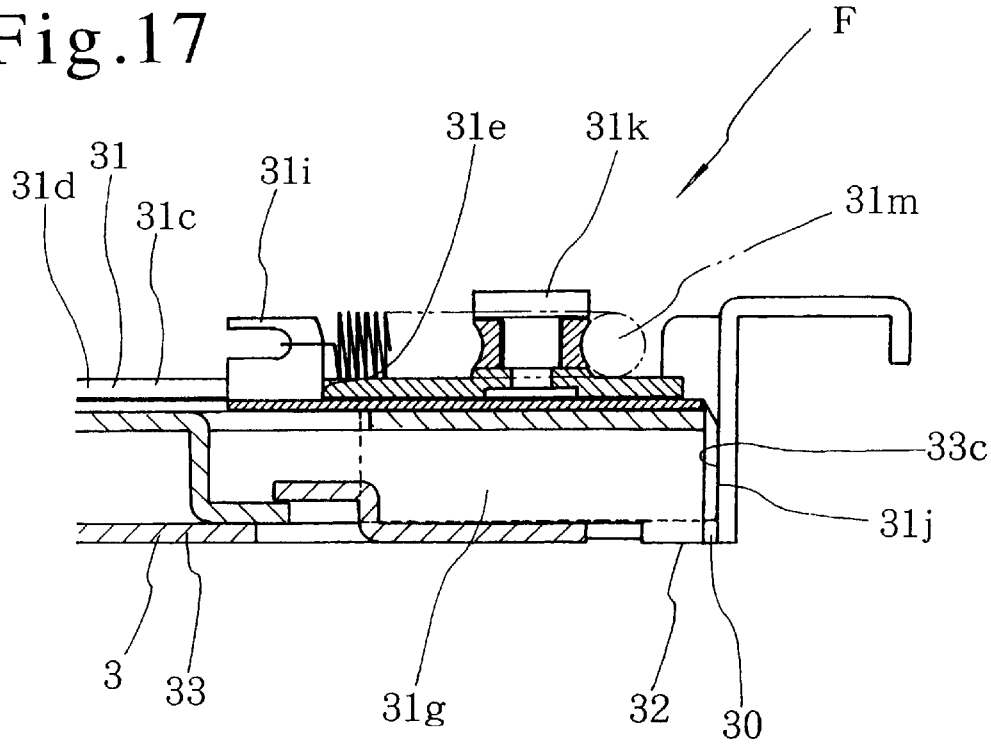
FIG. 17 is a front view partly broken showing a part of the front end side F of the frame cover 31 and the frame main body 33.

FIGS. 14 and 16 are respectively plain views of the front end side F of the frame cover 31 observed from an upper portion thereof wherein a part of the front end side F is broken. FIGS. 15 and 17 are respectively front views showing the front end side F of the frame cover 31 and the frame main body 33 wherein a part of the front end side F is broken. FIGS. 14 and 17 show a state that staple pins P are not inserted in the frame main body 33. FIGS. 16 and 17 show a state that the movement of a staple pin pushing tool 31*g* in a projecting direction is permitted by the spring action of a tensile coil spring 31*m* from the state of FIG. 14 or FIG. 15 whereby the front end side F of the frame main body 33 is slightly projected from the frame cover 31.

Figure 18:
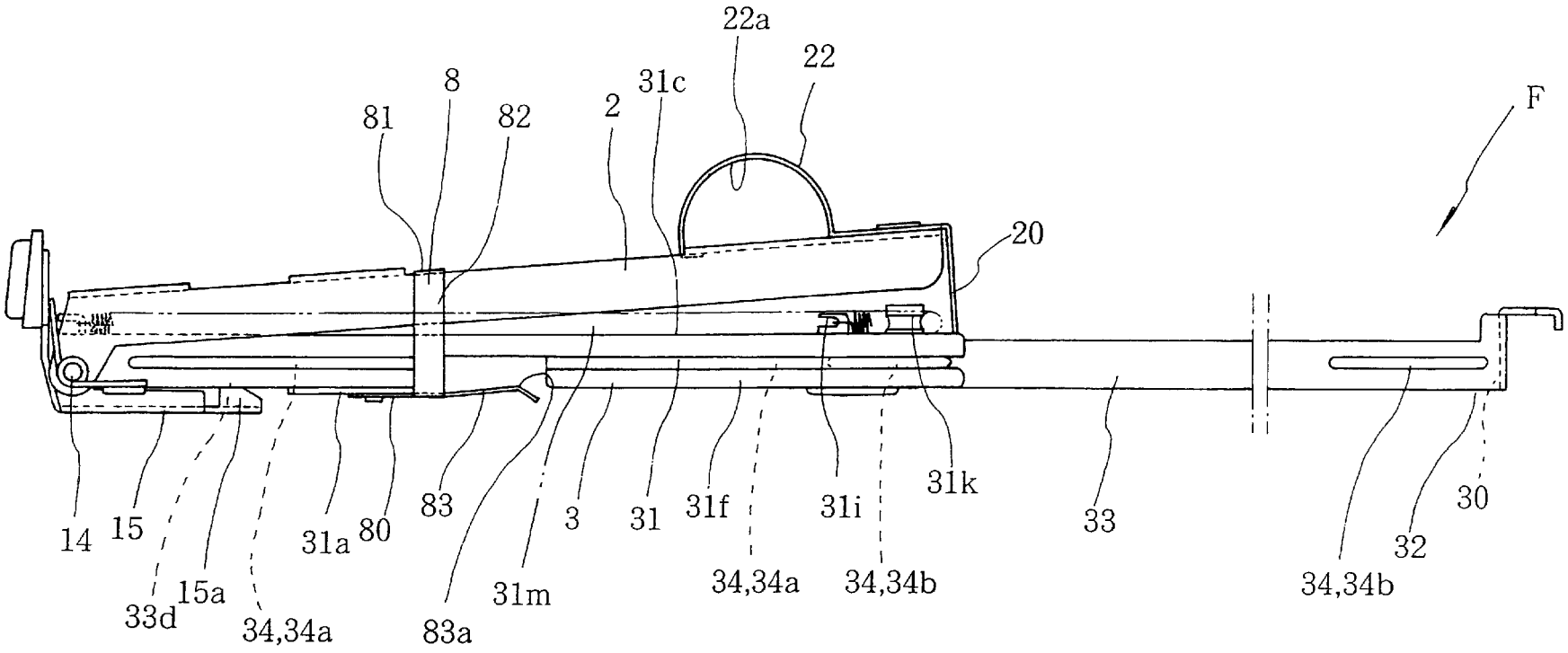
FIG. 18 is a front view of the frame cover 31 and the frame main body 33 in a state that the frame main body 33 is drawn from the frame cover 31 so that the insertion or replacement of staple pins P becomes ready.
Figure 19:
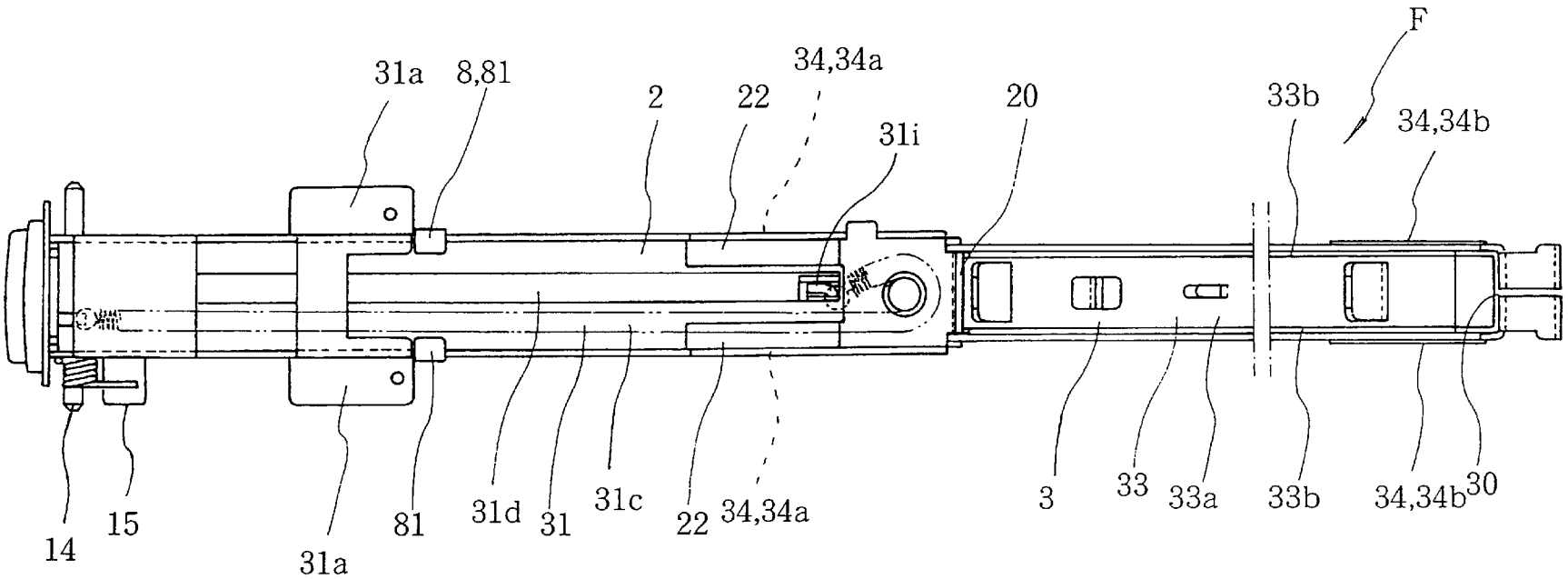
FIG. 19 is a plain view of the frame cover 31 and the frame main body 33 in the same state as in FIG. 18.

FIG. 18 is a front view of the punching arm 2 and the housing frame 3 in a state that the frame main body 33 is drawn from the frame cover 31 so as to be ready for inserting or replacing staple pins P. Further, FIG. 19 is a plain view of the punching arm 2 and the housing frame 3 shown in FIG. 18.

Figure 20:
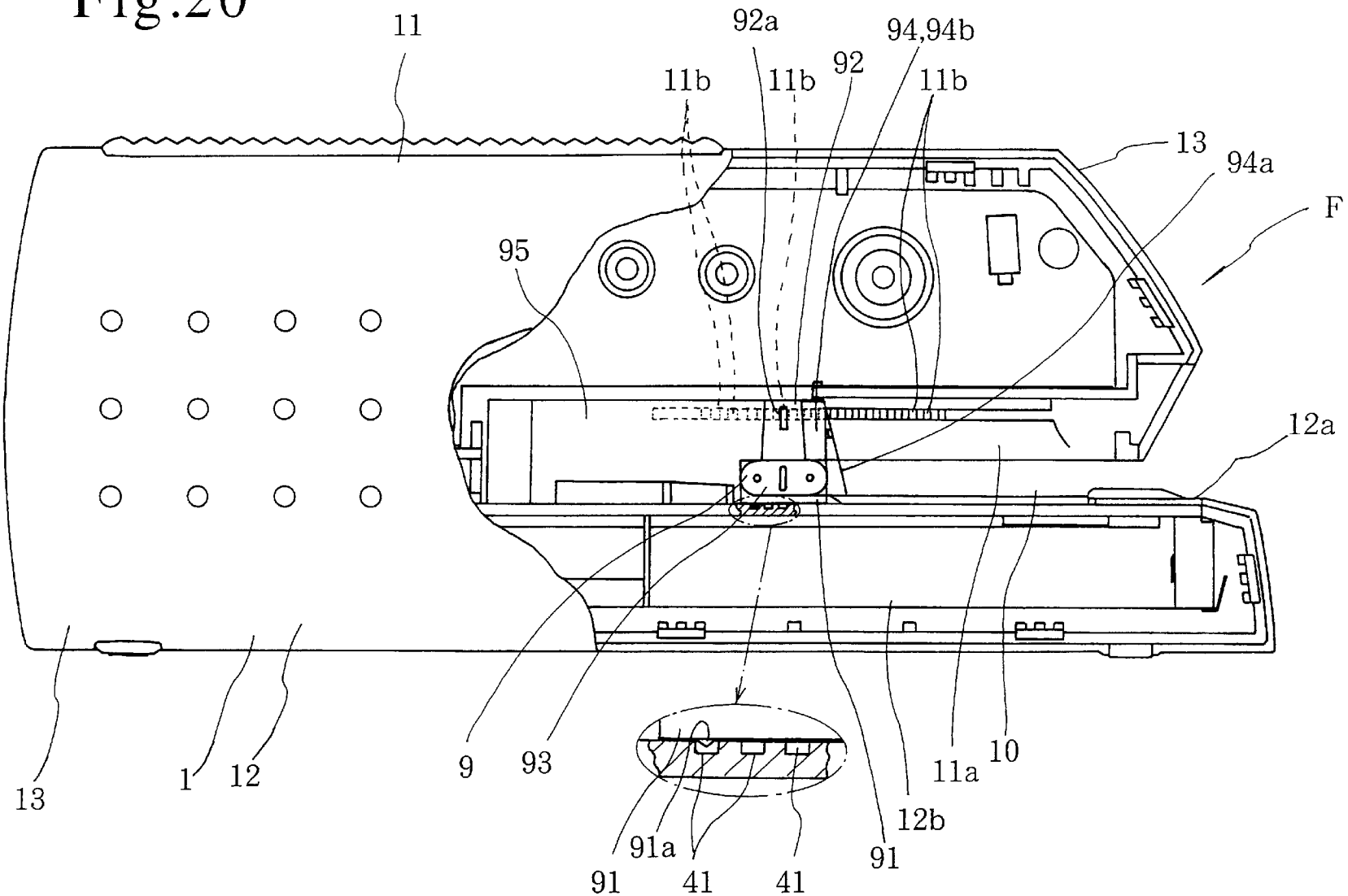
FIG. 20 is a front view partly broken of the power stapler of the present invention in which a movable member 9 is assembled and the punching arm 2 and the housing frame 3 are omitted and in which a part of the figure is shown in an enlarged view.
Figure 21:
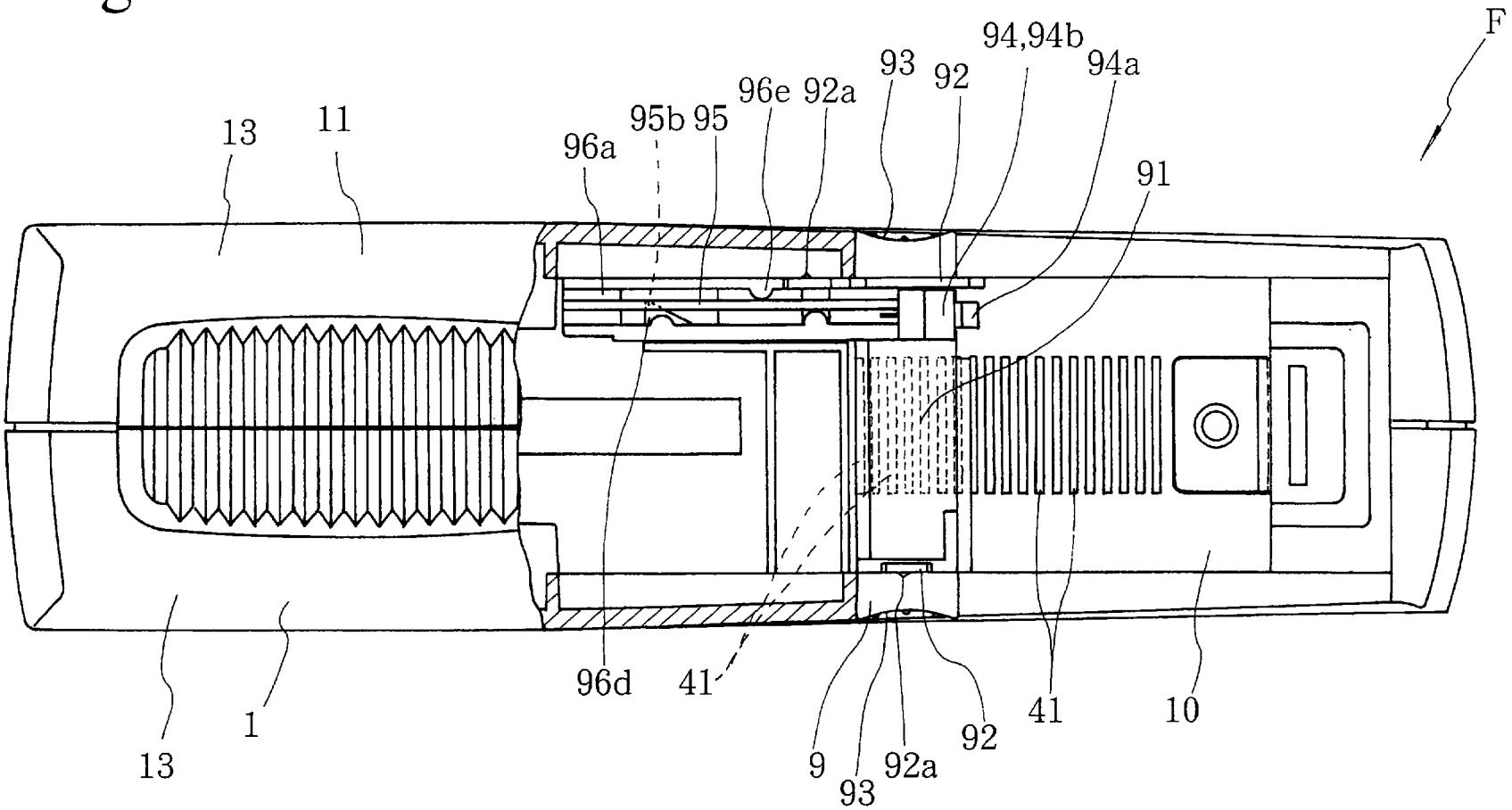
FIG. 21 is a plain view partly broken of the power stapler showing the same condition as in FIG. 20.

FIGS. 20 and 21 respectively show the power stapler in a state of omitting the punching arm 2 and the housing frame 3 so that control for the position of documents W to be inserted and the assembling of the movable member 9 provided with a switch for closing a control circuit for a motor 5 at the time of inserting the documents W can easily be understood. In particular, FIG. 20 shows from its one side constituent elements of the power stapler by braking a part of the casing half 13 and FIG. 21 shows from its upper side the constituent elements by braking a part the casing half 13.

Figure 22:
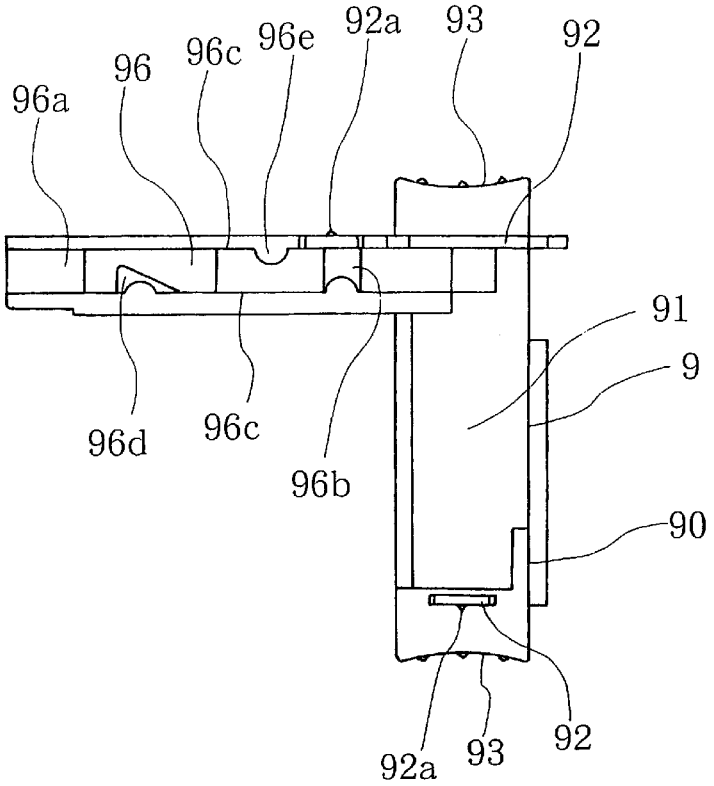
FIG. 22 is a front view of the movable member 9 without a switch substrate 95.
Figure 23:
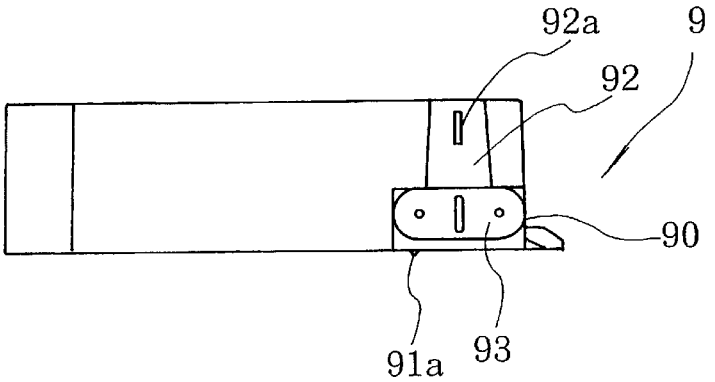
FIG. 23 is a side view of the movable member 9 in the same condition as FIG. 22.
Figure 24:
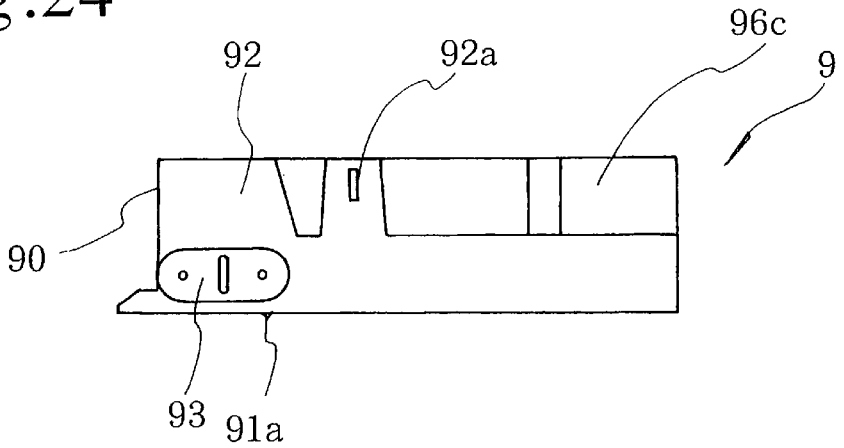
FIG. 24 is a side view of the movable member 9 in the same condition as FIG. 23 but the movable member is viewed from a different direction.
Figure 25:
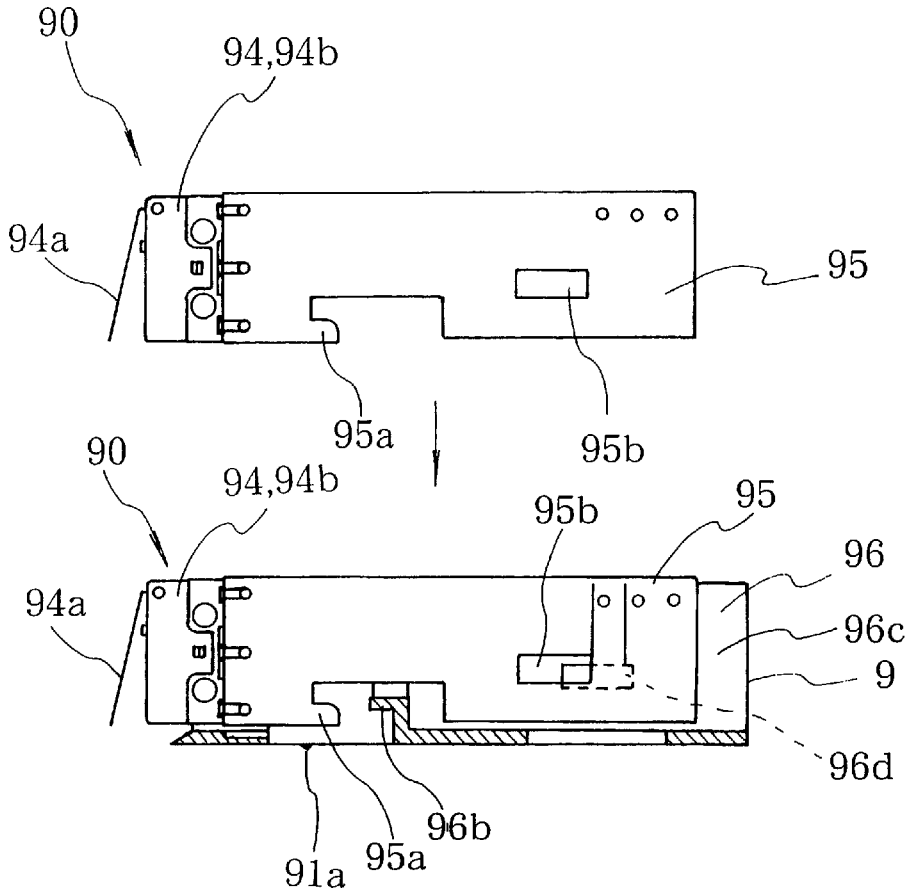
FIG. 25 is a diagram showing how the switch substrate 95 is assembled to the movable member 9.
Figure 26:
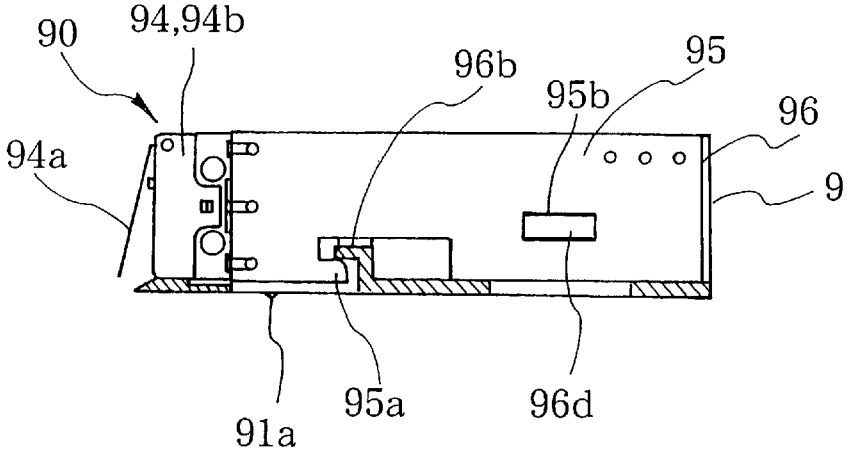
FIG. 26 is a diagram showing a state that the switch substrate 95 is assembled to the movable member 9.
Figure 27:
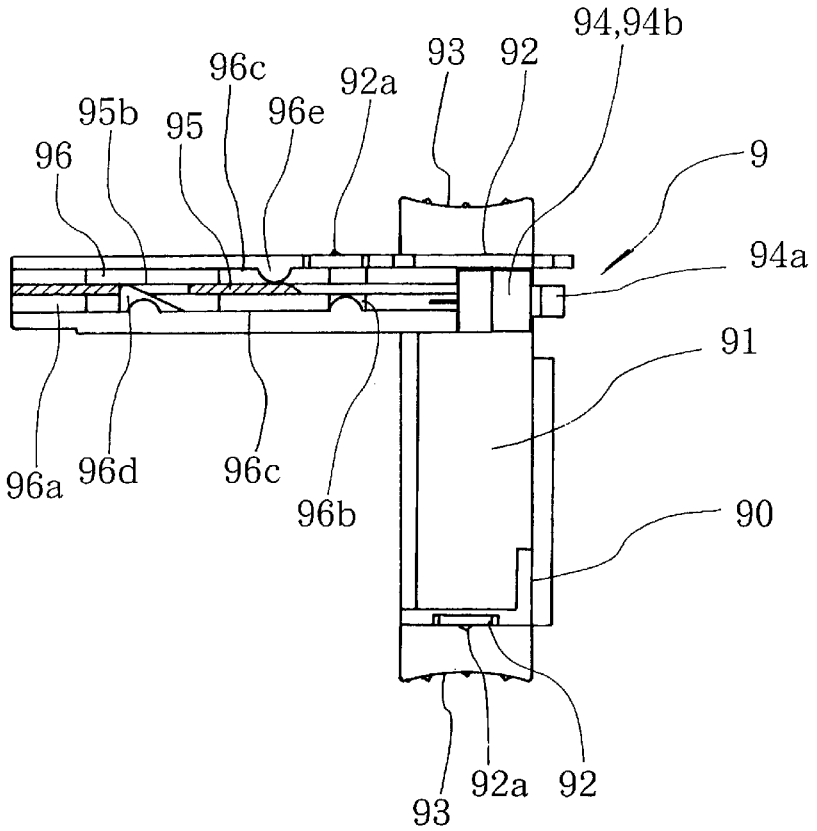
FIG. 27 is a front view showing a state that the switch substrate 95 is assembled to the movable member 9.
Figure 28:
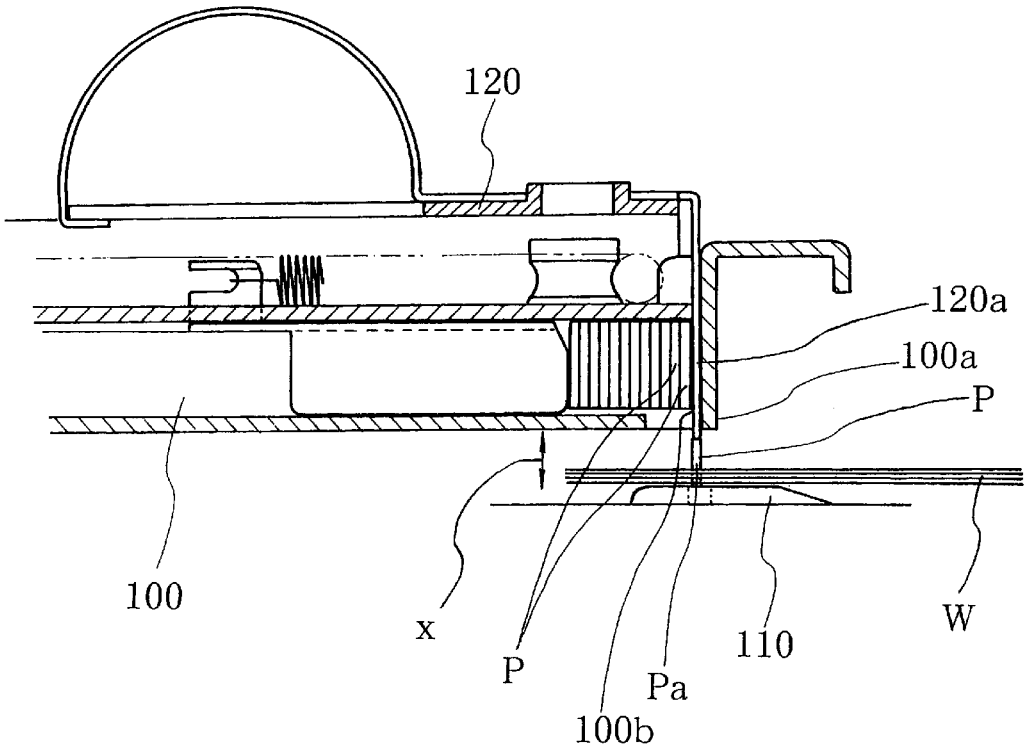
FIG. 28 is a diagram showing a relation among a housing frame, a punching arm and a base portion in an example to be examined.
Figure 29:
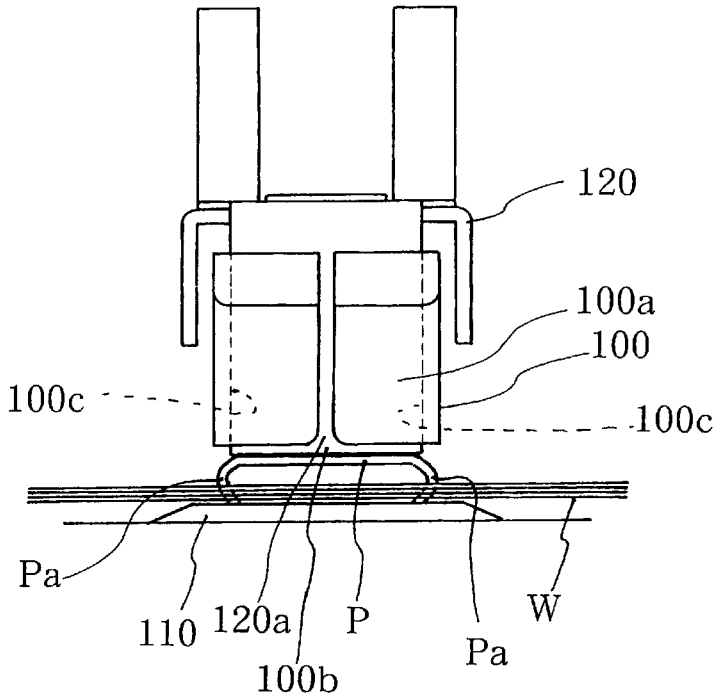
FIG. 29 is a diagram of the housing frame, the punching arm and the base portion viewed from a different direction.
Figure 30:
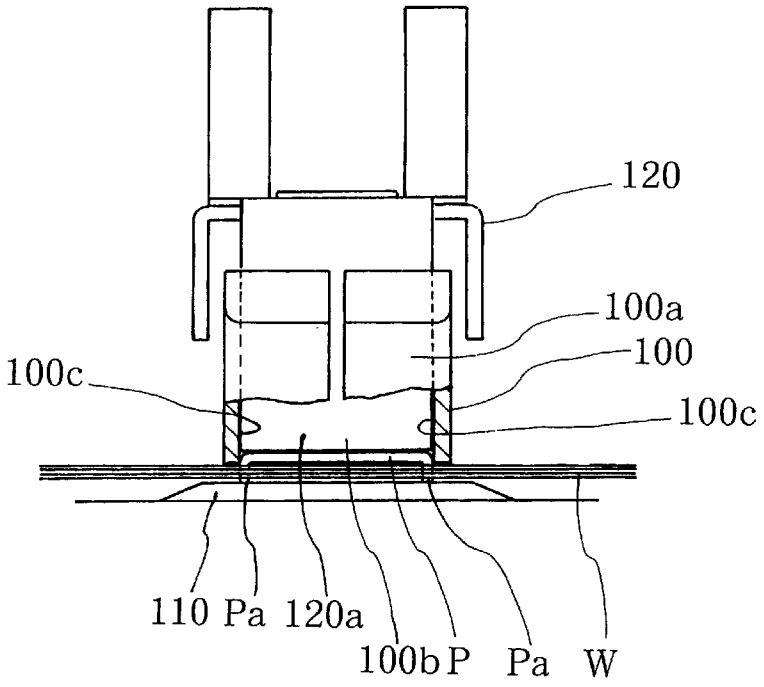
FIG. 30 is a diagram showing a relation among a housing frame, a punching arm and a base portion in an example to be examined.

FIGS. 22 through 24 respectively show the movable member 9 in a state without mounting thereon a switch substrate 95. FIG. 25 is a diagram explaining how the switch substrate 95 is assembled to the movable member 9. FIGS. 26 and 27 are respectively diagrams showing a state that the switch substrate 95 is assembled to the movable member 9.

The simple type power stapler of this Embodiment comprises the main body 1, containing therein constituent elements, which provides an insertion space 10 for permitting the documents W to be inserted from a lateral side, between an upper housing 11 and a lower housing 12. The upper housing 11 and the lower housing 12 are joined at a side opposite to the insertion space 10. The main body comprises symmetrically divided left and right housing components 13, 13 which are joined mutually at a position of substantially intermediate portion with respect to a vertical center of the main body 1.

The upper housing 11 in the main body 1 accommodates therein the punching arm 2 for punching staple pins P, the housing frame 3 for the staple pins P, the motor as a driving source for vertically moving the punching arm 2, a power transfer mechanism 6 for vertically moving the punching arm 2 by transducing a rotating motion of the driving shaft 50 of the motor 5 to a vertical motion, and a circuit substrate 7 on which a control circuit for controlling the motor 5 is formed. The upper housing 11 has an opened bottom 11*a* whereby at least the front end side F of the housing frame 3 and the punching arm 2 can be entered into the insertion space 10 from the upper portion by the aid of the driving force of the motor 5.

The lower hosing 12 in the main body 1 has a closed top 12*a*. A staple pin bending mound 40 is provided on the closed top 12*a* of the lower housing 12 at a position just below a front end of the housing frame 3. Namely, the upper portion of the lower housing 12 functions as a base portion 4 in the stapler. The lower housing 12 is provided with a battery receiving portion 12*b* for accommodating a battery which supplies power to the motor 5 through the control circuit on the circuit substrate 7.

The punching arm 2 has a rear end portion at a position opposite to the insertion space 10 in the main body 1, which is pivotally attached to the upper housing 11 by means of a laterally extending shaft 14 whereby the front end side F provided with a staple pin punching plate 20 is moved vertically around the shaft 14.

Further, the housing frame 3 has a rear end portion which is pivotally attached to the upper housing 11 by means of the same shaft 14 so as to have the same center of rotation as the punching arm 2, whereby the front end side F provided with a punching outlet 30 for staple pins P can be moved vertically.

The punching arm 2 is provided with a pair of side plates 21, 21 in a longitudinal direction of the punching arm 2, the pair of side plates being opposed to have a space in which the housing frame 3 is received. The housing frame 3 is supported in a hanging state to the punching arm 2 by the hanging means 8 which is located at an intermediate position in the longitudinal directional of the housing frame 3.

As clearly shown in FIGS. 11, 12, the hanging means 8 has a support member 80 for supporting a lower portion of the housing frame 3 and a hook member 81 which comprises a pair of hooks which engage with an upper portion of the punching arm 2. In this Embodiment, the support member 80 is constituted by a plate material extending at a right angle with respect to the longitudinal direction of the housing frame 3 and is attached to the housing frame 3 by screwing flanges 31*a* which are provided at a lower portion of the frame cover 31 as a part of the housing frame 3. Further, the support member 80 has a pair of arm plates 82 extending in one (an upper) direction with a space for accommodating therein the punching arm 2. Each free end of the arm plates 80 is bent inward at a right angle to form the above-mentioned hooks 81 which engage with an upper side portion of the punching arm 2.

The distance y between a lower surface of the hooks 81 and an upper surface of the support member 80 of the hanging means 8 restricts a downward movement of the punching arm 2 which punches out, by means of the staple pin punching plate 20 provided with the punching arm 2, through a staple pin punching outlet 30 a staple pin which is the nearest to the punching outlet 30 among staple pins P accommodated in the housing frame 3.

The stapling operations of the power stapler will be described with reference in particular to FIGS. 5 to 9. The upper housing 11 contains therein a gear train 60 which constitutes the power transfer mechanism 6 for power generated from the motor 5. Each gear 61, 61 . . . which constitutes the gear train 60 is assembled to the upper housing 11 in a state that each is supported by each rotation shaft extending in a lateral direction with respect to the longitudinal direction of the upper housing 11. A final gear 62 in the gear train 60 is disposed at a position just above the front end side F of the punching arm 2 (FIG. 9). A first gear 64 as a part of the gear train 60 comprises a small gear wheel 64*b* meshed with a second gear wheel 65 and a crown wheel 64*a* meshed with a pinion 51 formed on the driving shaft 50 of the motor 5. At both sides of the final gear 62, there are provided small rollers 63, functioning as a pushing member for moving vertically the punching arm, with the same axial line of rotation at positions which are eccentric to the axis of rotation of the final gear 62. In this Embodiment, a pair of supporting frames 22, 22 are formed in an upper portion of the punching arm 2 so as to have an arch projecting upward wherein the distance between the pair of supporting frames 22, 22 is enough to receive therebetween the final gear 62. Accordingly, the small rollers 63 are respectively in roll-contact with the inner surfaces of supporting frames 22, 22 when the final gear 62 is rotated.

In a state that the final gear 62 is rotated to a such position that the small rollers 63 are at the highest position as shown in FIG. 5, the rolling surface of the small rollers 63 is in contact with the inner surface 22*a* of the supporting frames 22 at the highest position. At this position of the small rollers 63, the punching arm 2 is hanged at a position that the staple pin pushing plate 20 does not punch out the staple pins P accommodated in the housing frame 3. Further, in this state, the housing frame 3 is hanged to the punching arm 2 by means of the hanging means 8 in a state that the insertion space 10 for the documents W is formed between a lower surface of the front end of the housing frame 3 and the base portion 4 (the state shown in FIG. 5 is referred to as a set-up state). In this state, the power stapler in this Embodiment is so designed that an upper edge 23 of the punching arm 2 divides substantially equally in a vertical direction an imaginary plane surrounded by a circular locus of the small roller 63 due to the rotation of the final gear 62.

When the final gear 62 is rotated counter-clockwise by the driving force of the motor 5 from the set-up state in FIG. 5, the small rollers 63 attached to the final gear 62 are moved toward side portions of the supporting frames 22. With the movement of the small rollers 63, the front end side F of the punching arm 2 supported in a hanged state in association with the supporting frames 22 and the small rollers 63 and the front end side F of the housing frame 3 hanged to the punching arm 2 by means of the hanging means 8 are rotated downward around the center of the shaft 14 by their own weight to a position that the lower surface 32 of the front end side of the housing frame 3 becomes contact with an upper surface of documents W inserted in the space 10 (FIG. 7).

When the final gear 62 is further rotated counter-clockwise by the driving force of the motor 5 from the state shown in FIG. 7, the small rollers 63 attached to the final gear 62 are pressed to an upper side 24 of the front end portion of the punching arm 2. Since the upper edge 23 of the punching arm 2 is so designed as mentioned before that it divides, in the set-up state, substantially equally in a vertical direction of the imaginary plane surrounded by the locus of movement of the small rollers 63, the front end side F of the punching arm 2 is further rotated downward around the shaft 14 by the movement of the small rollers 63 which are moved downward by the rotation of the final gear 62. Then, the staple pin punching plate 20 formed in the punching arm 2 punches out a staple pin P located just above the punching outlet 30 of the housing frame 3 through the punching outlet 30, whereby the documents W are stapled with the staple pin P (FIG. 8). The state shown in FIG. 8 is referred to as a stapling completion state.

When the final gear 62 is further rotated counter-clockwise by the driving force of the motor 5 from the stapling completion state in FIG. 8, the small rollers 63 are moved upward with their roller surfaces being in slide-contact with the inner surfaces of the supporting frames 22. Then, the upward movement of the small rollers 63 causes an upward rotation of the front end side F of the punching arm 2 around the center of the shaft 14 so that the staple pin punching plate 20 is moved so as to be drawn from the housing frame 3. When the punching arm 2 is rotated upward, the hook member 81 of the hanging means 8 again engages with the upper portion of the punching arm 2 with the result that the front end side F of the housing frame 3 whose lower surface 32 is pushed to the documents W by means of the hanging means 8 is moved upward. Thus, one-cycle driving of the motor 5 is finished at a time when the small rollers 63 of the final gear 62 are returned to the position initiating the downward movement, i.e., the highest position of the small rollers 63. Returning of the small rollers 63 to the position just before the initiation of the movement presents the before-mentioned set-up state wherein the insertion space 10 for the documents W is formed between the front end of the housing frame 3 and the base portion 4 (FIG. 5).

The simple type power stapler according to this Embodiment has such construction that when the stapling operations for stapling pins P are to be carried out to the documents W, the lower surface 32 of the front end of the housing frame 3 can be moved downward to the position where the lower surface 32 is pushed to the upper surface of the documents W, and after the completion of a stapling operation of one cycle, the insertion space 10 for the documents W can properly be assured again between the lower surface 32 of the front end of the housing frame 3 and the base portion 4 without using a frame biasing spring (a return spring for the housing frame 3 which is interposed between the base portion 4 and the housing frame 3 to return the housing frame 3 to the original position after the completion of a stapling operation). As a result, according to the simple type power stapler of this Embodiment, the insertion space 10 for the documents W can be maintained large in a vertical direction, and it is possible to perform the stapling operations for the staple pins to the documents W while an amount of consumption power required for the one stapling operation by the battery can be minimized.

Further, in this Embodiment, the housing frame 3 comprises the frame main body 33 provided with a staple pin receiving portion 33*a* at its upper surface side and the frame cover 31 having a opened bottom 31*b* which covers an upper surface of the frame main body 33.

In the staple pin receiving portion 33a of the frame main body 33, there are formed two groove portions 33*b*, 33*b* each having an opened top, extending in a longitudinal direction of the frame main body 33. The staple pin receiving portion 33*a* can receive a plurality of staple pins P, P . . . pins such a manner that each of the two grooves 33*b*, 33*b* receives each of the leg portions of the staple pins P.

The frame cover 31 of the frame main body 33 has an opened bottom portion 31*b* and it comprises an upper plate portion 31*c* covering an upper surface of the frame main body 33 and a pair of side walls 31*f*, 31*f* which are formed to have a space in which the frame main body 33 is interposed, the upper plate portion and the pair of side walls being extended in a longitudinal direction of the frame cover 31.

The upper plate portion 31*c* of the frame cover 31 is provided with an elongated opening 31*d* extending in a longitudinal direction of the frame cover 31. Between the pair of side walls 31*f*, 31*f* of the frame cover 31, there is the staple pin pushing tool 31*g* which is provided with two leg plate portions 31*h* each being fitted to each of the two groove portions 33*b*, 33*b* of the frame main body 33. The staple pin pushing tool 31*g* is further provided with a claw 31*i* projecting upward through the elongated opening 31*d* of the frame cover 31. Above the frame cover 31, there is provided a tensile coil spring 31*m* having an end which is fixed to a rear end side of the frame cover 31 and the other end which is engaged with a projection 31*k* provided at a front end of the frame cover 31.

The side walls 31*f* extending in the longitudinal direction of the frame cover 31 and side walls extending in the longitudinal direction of the frame main body 33 have mutually fitted elongated grooves 34*a* and elongated projections 34*b* to form an assembling members 34 for assembling the frame cover 31 and the frame main body 33. In this Embodiment, the elongated groove 34*a* is formed in an inner surface of each of the side walls 31*f*, 31*f* of the frame cover 31 in its longitudinal direction, and the elongated projection 34*b* is formed in an outer surface of the side walls of the frame main body 33 in its longitudinal direction wherein each of the elongated projections 34*b* is fitted to each of the elongated grooves 34*a*, thus the assembling member 34 is formed.

In this Embodiment, the frame main body 33 is assembled to the frame cover 31 in such a manner that the pair of leg plate portions 31*h*, 31*h* of the staple pin pushing tool 31*g* are received in the two groove portions 33*b*, 33*b* of the frame main body 33 so that the staple pin pushing tool 31*g* is guided and moved in the grooves 33*b*, and the elongated projections 34*b* of the frame main body 33 are fitted to the elongated grooves 34*a* of the frame cover 31.

Thus, the power stapler of this embodiment has a two element structure comprising the frame cover 31 and the frame main body 33. Accordingly, the housing frame 3 is capable of drawing the frame main body 33 from the front end side F of the housing frame 3 when staple pins P are to be inserted. Namely, according to the simple type power stapler of this embodiment, since the assembling member 34 for assembling the frame cover 31 and the frame main body 33 comprises the before-mentioned elongated grooves 34*a* and elongated projections 34*b*, the frame main body 33 can be drawn along the elongated grooves 34*a*. Further, the movement in the drawing operation can be smooth without causing looseness in the longitudinal direction by determining a sufficient length for the elongated projections 34*b*. The provision of the assembling member 34 allows using the frame cover 31 having an opened bottom portion 31*b*, and accordingly, the dimension in a vertical direction of the housing frame 3 can be reduced for a lower plate in comparison with a case that it is provided in the frame cover 31.

In this embodiment, a front edge 31*j* of the staple pin pushing tool 31*g* is brought to contact with an inner surface 33*c* of the front end of the frame main body 33 at a position where the frame main body 33 is entirely accommodated in the frame cover 31 (FIGS. 12, 14 and 15). An engaging opening 33*d* is formed in a lower surface of a rear end side of the frame main body 33. An engaging claw 15*a* of a lock member 15 is formed in a rear end portion of the main body 1. At the entirely accommodated position, the engaging claw 15*a* is engaged with the engaging opening 33*d* so as to maintain a state that the frame main body 33 is kept at the entirely received position. The lock member 15 comprises a first portion 15*b*, which is extended in a longitudinal direction of the frame main body 33 and provided with the engaging claw 15*a* and a second portion 15*c* which is extended vertically at an outside of the main body 1. The lock member 15 is urged by a torsion spring 16 wound around the shaft 14 so that the engaging claw 15*a* of the first portion 15*b* is always pressed upward. Accordingly, when the second portion 15*c* of the lock member 15 is pushed from an outer side, the first portion 15*b* is moved downward against the spring action of the torsion spring 16, whereby the engaging claw 15*a* is disengaged from the engaging opening 33*a* of the frame main body 33. As shown in FIGS. 14 and 15, the staple pin pushing tool 31*g* can be moved to such a position that the claw 31*i* is brought to contact with the front end 31*e* of the elongated opening 31*d* formed in the frame cover 31. However, the front edge 31*j* of the staple pin pushing tool 31*g* is in contact with an inner surface 33*c* of the fame main body 33 in a state that a gap z is formed between the front end 31*e* of the elongated opening 31*d* and the claw 31*i* at the before-mentioned entirely received position even though the staple pins are not inserted. Accordingly, when the lock member 15 is operated to disengage the engaging claw 15*a* from the engaging opening 33*d* of the frame main body 33, the staple pin pushing tool 31*g* can be moved by the spring action of a tensile coil spring 31*m* for a distance corresponding to the gap z formed between the front end 31*e* of the elongated opening 31*d* and the claw 31*i* of the staple pin pushing tool 31*g* even though the staple pins P are not inserted between the front end 31*g* of the staple pin pushing tool 31*g* and the inner surface 33*c* of the front end of the frame main body 33, whereby the frame main body 33 with the inner surface 33*c* to which the front end 31*g* of the staple pin pushing tool 31*g* is contacted, can be moved to project from the frame cover 31 (FIGS. 16 and 17).

The position of staple pin pushing tool 31*g* is retracted in the frame main body 33 as a much amount of staple pins P is loaded in the frame main body 33. In a case that the engaging claw 15*a* of the lock member 15 is disengaged from the engaging opening 33*d* of the frame main body 33, an amount of movement of the frame main body 33 in a direction of projection becomes large. Further, the energy of the movement in the direction of projection of the frame main body 33 becomes strong since the tensile spring 31*m* is further stretched. In this embodiment, the opened bottom portion 31*b* of the frame cover 31 is utilized as follows. A leaf spring 83 having a portion which is bent in a ridge-like form to provide a top 83*a* is attached to the support means 80 of the hanging means 8. The top 83*a* of the leaf spring 83 is elastically in slide-contact with a lower surface of the frame main body 33 when the frame main body 33 is moved in the direction of projection whereby the movement of the frame main body 33 is controlled.

The movable member 9 is provided in the insertion space 10 formed between the base portion 4 and the housing frame 3 so as to be movable from the front end side F of the housing frame 3 to a rear side of the housing frame 3. The movable member 9 is provided with at its both sides a pair of vertically extending insertion controlling portions which face a front end of the documents to be inserted in the insertion space 10.

The movable member 9 will be described in more detail with reference to FIGS. 20 and 21. The movable member 9 has a laterally elongated plate portion 91 which is brought to contact with an upper surface of the base portion 4. At both sides of the laterally elongated plate portion 91, there are vertically extending guide plates 92 which are in slide-contact with inner surfaces of the upper housing 11 in the insertion space 10. A laterally extending projection 91*a* is formed in a lower surface of the laterally elongated plate portion 91 in the movable member 9, and a vertically extending projection 92*a* is formed at an outer side of each of the vertically extending guide plates 92. A plurality of lateral grooves 41, 41 . . . are formed in an upper surface of the base portion 4 so that the projection 91*a* formed in the lower surface of the laterally elongated plate portion 91 is fitted. A plurality of vertically extending grooves 11*b*, 11*b* . . . are formed with predetermined intervals in each inner surface of the upper housing 11 facing the insertion space 10 so that the projections 92*a* formed in the outer surfaces of the guide plate 92 of the movable member 9 are fitted. With such construction, when the movable member 9 is moved from the front end side F to the rear end side of the housing frame 3 and vice versa, each of the projections 91*a*, 91*a* formed in the movable member 9 is elastically drawn from one of the grooves 91*b*, 91*b* . . . , 41, 41 . . . formed in the base portion 4 and the upper housing 11, and when the movable member 9 is stopped, each of the projections is elastically fitted to one of the other grooves 11*b*, 11*b* . . . , 41, 41 . . . Accordingly, the movable member 9 can be moved to a predetermined position in the insertion space 10 without any change of posture of the movable member 9 and the movable member 9 can be positioned stably at the predetermined position of movement.

At both end portions of the laterally elongated plate portion 91 as a part of the movable member 9, finger-operable portions 93 are formed to project from side portions of the insertion space 10. The fingeroperable portions 93, 93 can be clamped by two finger chips of a single hand to thereby move the movable member 9.

A switch 94 is provided at one side of the vertically extending controlling portions 90 of the movable member 9. The switch 94 is to close the circuit for controlling the driving force of the motor 5 when an end of the documents W inserted in the insertion opening 10 is bought to contact with the switch 94. The switch 94 may have a switch unit 94*b* including a switch plate 94*a* comprising a spring plate which urges the switch to a detection normally opened. Accordingly, the distance between the controlling portions 90 of the movable member 9 and the staple pin punching outlet 3 of the housing frame 3 as well as a desired point of movement of the movable member 9 can be changed, whereby the position of stapling the stapling pins P to the documents W can be changed.

The switch unit 94*b* is assembled to a front end portion of a switch substrate 95 having a shape elongated in a direction of the movement of the movable member 9, the switch unit 94*b* being electrically connected to a circuit formed on the switch substrate 95. The movable member 9 is provided with a groove 96, to be fitted with the switch substrate 95, along a direction of the movement of the movable member 9. The groove 96 is opened at its upper portion and both ends. A hook portion 96*b* is formed in the bottom 96*a* of the fitting groove 96. The hook portion 96*b* is engaged with a claw 95*a* which is formed at a lower portion of the switch substrate 95 so as to project toward a rear end side of the switch substrate 95 when the switch substrate 95 is inserted from the rear end side F of the fitting groove 96. The fitting groove 96 has, on one hand, a groove wall 96*c* provided with a projection 96*d* which is fitted to an engaging opening 95*b* formed at a rear end side of the switch substrate 95 at a position that the claw 95*a* of the switch substrate 95 is engaged with the hook portion 96*b* and has, on the other hand, a groove wall 96*c* provided with a raised portion 96*e* which is pushed to a surface of the switch substrate 95 so that the substrate 95 is elastically pressed to the other groove wall 96*c*.

The switch substrate 95 is inserted into the fitting groove 96 of the movable member 9 from its upper portion so that the claw 95*a* of the switch substrate 95 is positioned at a front side of the hook portion 96*b* as shown in FIG. 25. Then, by moving the switch substrate 95 in a rear side, the claw 95*a* is engaged with the hook portion 96*b* and the engaging opening 95*b* receives the projection 96*d* whereby the switch substrate 95 can be fitted to the fitting groove 96 in one-touch operation so as not to draw the switch substrate 95 from the switching groove 96 (FIGS. 26 and 27). Namely, the switch 94 can easily be attached to the movable member 9.

In accordance with the simple type power stapler of the present invention, the front end side of the staple pin housing frame as a part of the stapler can vertically be moved without any trouble in stapling operations, and can reduce electrical power necessary for the operations to a necessary minimum extent. Further, the stapler of the present invention can perform suitable stapling operations to the documents W so as to be flexible with a change of the thickness of the documents to be stapled by the stapler.

Obviously, numerous modifications and variations of the present invention are possible in light of the above teachings. It is therefore to be understood that within the scope of the appended claims, the invention may be practiced otherwise than as specifically described herein.

What is claimed is:

1. A simple type power stapler which comprises:

a main body having a base portion, a punching arm having a rear end portion which is pivotally connected to the main body and a front end portion provided with a staple pin punching plate, a housing frame for staple pins which has a rear end portion pivotally connected to the main body and a front end portion provided with a staple pin punching outlet, and a hanging means for hanging the housing frame to the punching arm, which is provided with a hook member engaging with an upper portion of the punching arm and a support member for supporting a lower portion of the housing frame, wherein the main body includes a pushing member which is vertically movable by driving a motor, a supporting frame for accommodating the pushing member so as to be movable in a vertical direction is provided in an upper portion of the punching arm, a space for an object to be stapled is formed between the front end portion of the housing frame and the base portion in a state that the punching arm and the housing frame are hanged by the pushing member, when it is at an upper position, in association with the supporting frame, the punching arm and the housing frame are so adapted to descend by their own weight when the pushing member is moved downward by the driving force of the motor whereby a lower surface of the front end portion of the housing frame comes to contact with an upper surface of the object to be stapled, and the distance between the hook member and the support member of the hanging means is determined to have a dimension which allows the downward movement of the front end portion of the punching arm caused by the movement of the pushing member to its lowest position whereby staple pins in the housing frame are punched out by the staple pin punching plate through the punching outlet.

2. The simple type power stapler according to claim 1, wherein the housing frame comprises a frame main body provided with a staple pin receiving portion at its upper side and a frame cover having an opened bottom, which covers an upper surface of the frame main body, wherein a pair of side walls formed in a longitudinal direction of the frame cover and a pair of side walls formed in a longitudinal direction of the frame main body are assembled with a pair of assembling members comprising elongated grooves and elongated projections, which are mutually fitted, so that the frame main body is drawn from a front end side of the housing frame out of the frame cover so as to be ready for setting staple pins.

3. The simple type power stapler according to claim 1, wherein a movable member on which a switch is mounted is provided so as to be movable from a front side of the housing frame toward a rear side thereof, said switch is adapted to close a circuit for the motor when the switch comes to contact with an end of the object to be stapled which is inserted between the base portion and the front end portion of the housing frame.

* * * * *